US007293360B2

(12) United States Patent
Steigerwalt et al.

(10) Patent No.: US 7,293,360 B2
(45) Date of Patent: Nov. 13, 2007

(54) KNIFE BLADE OPENING MECHANISM

(75) Inventors: Kenneth Steigerwalt, Orangeville, PA (US); Matthew Lerch, Sussex, WI (US)

(73) Assignee: Mentor Group, LLC, Oregon City, OR (US)

( * ) Notice: Subject to any disclaimer, the term of this patent is extended or adjusted under 35 U.S.C. 154(b) by 4 days.

(21) Appl. No.: 11/395,917

(22) Filed: Mar. 31, 2006

(65) Prior Publication Data

US 2006/0230620 A1 Oct. 19, 2006

Related U.S. Application Data

(60) Provisional application No. 60/671,146, filed on Apr. 13, 2005.

(51) Int. Cl.
*B26B 1/04* (2006.01)

(52) U.S. Cl. ..... 30/160; 30/159

(58) Field of Classification Search ..... 30/155, 30/158, 159, 160, 161
See application file for complete search history.

(56) References Cited

U.S. PATENT DOCUMENTS

| | | | | |
|---|---|---|---|---|
| 6,308,420 | B1 * | 10/2001 | Moser | 30/161 |
| 6,574,869 | B1 * | 6/2003 | McHenry et al. | 30/161 |
| 6,651,344 | B2 * | 11/2003 | Cheng | 30/159 |
| 6,675,484 | B2 * | 1/2004 | McHenry et al. | 30/161 |
| 7,086,157 | B2 | 8/2006 | Vallotton | |
| 2004/0261272 | A1 * | 12/2004 | Moser | 30/160 |
| 2006/0059694 | A1 * | 3/2006 | Carter, III | 30/159 |
| 2006/0064877 | A1 * | 3/2006 | Vallotton et al. | 30/153 |

* cited by examiner

*Primary Examiner*—Hwei-Siu C. Payer
(74) *Attorney, Agent, or Firm*—Hancock Hughey LLP

(57) ABSTRACT

A folding knife incorporates an opening assist mechanism that functions to drive the blade from the closed to the open position. The knife may be either automatic or semi-automatic. In one embodiment a pair of spring arms, one located to each lateral side of the blade is interconnected at their forward ends with a pin and a roller sleeve. The spring arms apply pressure to the tang of the blade when the blade is closed.

19 Claims, 14 Drawing Sheets

KNIFE BLADE OPENING MECHANISM

FIELD OF THE INVENTION

This invention relates to knives equipped with mechanisms that provide an opening assist for the blade, either automatic or otherwise, and more particularly to a knife in which spring members interconnected with a drive pin act on the blade to drive the blade to the open position.

BACKGROUND

Most folding knives incorporate some kind of a mechanism that holds the blade or working implement safely in the closed position in which the sharp edge of the blade is held safely within the handle. There are many known mechanisms for retaining blades in the closed position, and there are obvious reasons why such mechanisms are used. Among other reasons, blade-retaining mechanisms prevent unintended opening of the knife and thus promote safety.

Automatic opening mechanisms and so-called "opening assist" mechanisms may be incorporated into folding knives. Generally speaking, in a knife that has an automatic opening mechanism the blade is held in the closed position by a latched trigger mechanism. When closed, the blade is under a constant "pre-load" pressure from a spring mechanism. When the trigger is released, the blade is automatically driven by the spring mechanism into the open position. On the other hand, with knives that incorporate opening assist mechanisms the blade is retained in the closed position without the need for a latch or trigger. The opening assist function is provided by a spring mechanism that operates on the blade. As the user manually rotates the blade from closed toward the open position, the spring mechanism that acts on the blade reaches a threshold point or top-dead-center point. After the blade rotates beyond the threshold point the spring drives the blade to the open position. Opening assist knives are also often called "semi-automatic" knives.

Both knives equipped with automatic and opening assist mechanisms typically include some kind of locking mechanism to lock the blade open, and with many opening assist knives the same spring mechanism that drives the blade open also retains the blade closed.

For a variety of reasons, opening assist mechanisms are becoming very popular. For example, in appropriate circumstances and for appropriate users, there are many advantages to be derived from semi-automatic opening knives and many situations where automatic knives can be useful. These often include situations where the user has only one hand free. However, even in a knife that includes an automated opening or opening assist mechanism, safety considerations always mandate that the blade stays in the closed position until the user volitionally and intentionally moves the blade into the open position. For example, a mechanism that holds a knife blade closed should never release when the knife is dropped. With the recent increases in popularity of opening assist knives there are many new types of mechanisms being developed.

There is always a need however for mechanisms that provide an automatic or semi-automatic opening feature for knives.

The present invention comprises folding knife having an opening assist mechanism that may be either automatic or of the type more typically called opening assist styles. It will be appreciated that in the present discussion the term "opening assist" mechanism refers to a mechanism that may be used with either an automatic knife or a semi-automatic knife; both types of knives are detailed below and shown in the drawings. The mechanism of the present invention uses a pair of spring arms, one on each lateral side of the blade and interconnected at their free ends with a pin to apply pressure to the blade to drive it to the open position. An automatic knife using the mechanism of the present invention has a differently configured blade where the pin acts on the blade from an opening assist knife that incorporates the mechanism. With respect to the opening assist functionality used in a semi-automatic knife, once a threshold point in the rotational movement of the blade is passed as the blade is moved from the closed toward the open position, the mechanism of the present invention rotationally drives the blade into the fully open position. This is accomplished with the paired spring arms acting through the interconnecting roller pin, which acts on the blade and thereby imparts sufficient rotational kinetic energy to the blade that the inertia drives the blade into the fully open position. A locking mechanism locks the blade in the open position.

BRIEF DESCRIPTION OF THE DRAWINGS

The invention will be better understood and its numerous objects and advantages will be apparent by reference to the following detailed description of the invention when taken in conjunction with the following drawings.

in FIG. 1 the blade is shown in the open position.

in FIG. 9 the blade is shown in the open position.

In FIG. 17 the near side handle and liner are removed to illustrate internal components.

In FIG. 26 the knife is shown in side view with the near side components removed to expose the interior components.

DETAILED DESCRIPTION OF THE PREFERRED EMBODIMENTS

Figure 1:
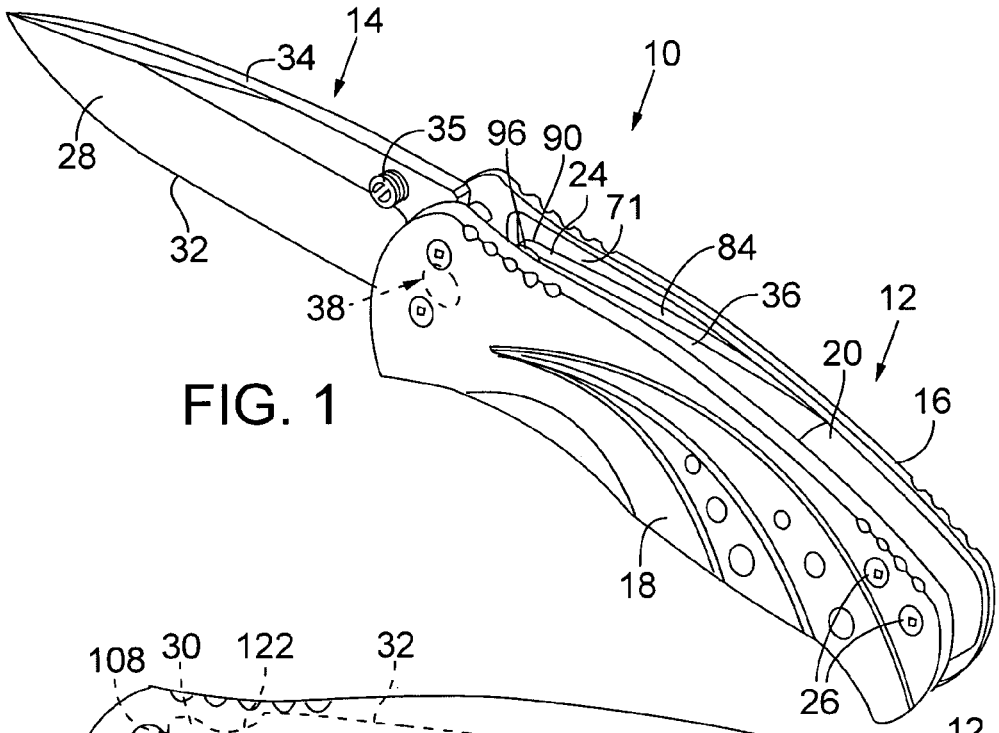
FIG. 1 is perspective view of a first illustrated embodiment of a knife incorporating an opening assist mechanism according to the present invention. The knife shown in FIGS. 1 through 8 is a semi-automatic knife.
Figure 2:
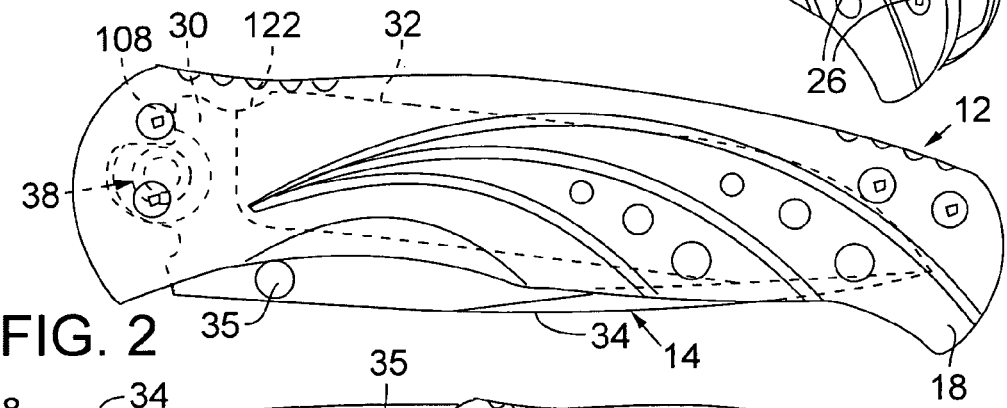
FIG. 2 is side elevation view of the knife illustrated in FIG. 1 with the blade shown in dashed lines stowed in the closed position.
Figure 3:
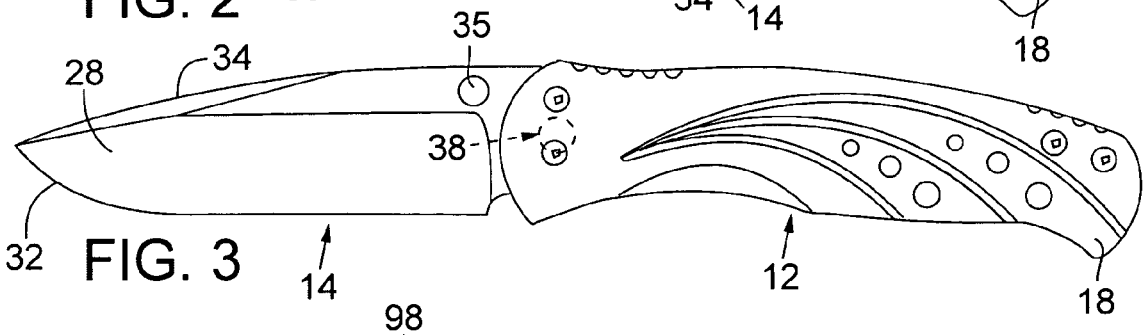
FIG. 3 is side elevation view similar to FIG. 2 with the blade in the open position.

A first illustrated embodiment of a folding knife 10 incorporating an opening assist mechanism according to the present invention is illustrated in FIGS. 1 through 8. Folding knife 10 includes an elongate handle 12, and a blade 14 that is pivotally attached to the handle at one of its ends—referred to herein as the "forward" end of the handle. Other relative directional terms correspond to this convention: the "rear" end of the handle is opposite the forward end; the "upper" part of the blade is the dull, non-working portion and the "lower" part of the blade is the sharpened, working portion; "inner" or "inward" refers to the structural center of the knife, and so on. FIG. 1 shows the knife 10 with the blade 14 in the open position, and in FIG. 2 the blade is shown in the closed position in which the blade, shown in dashed lines in FIG. 2, is received within the handle 12. The blade 14 of the knife 10 of the present invention is capable of being locked securely in the open position to prevent the inadvertent movement of the blade to its closed position. The blade locking mechanism is described below.

Handle 12 of knife 10 comprises several components, including a pair of oppositely located side wall sections, generally indicated at 16, 18, that are parallel with each other and held spaced apart from one another by a spine member or spacer 20 which is located between the side wall sections along their upper long edges and which curves around the rearward end of the handle. Side wall sections 16 and 18 may be fabricated from any suitable material such as a reinforced synthetic plastic; other suitable materials include metal, other plastics, wood, etc. The side wall sections may be fabricated in singled or multiple pieces. Spine 20 is preferably made of steel, although other materials may be used.

When handle 12 is assembled, the spine 20 is disposed between the side walls 16 and 18 and extends along the upper margins of the side walls. As illustrated in FIGS. 1 and 2, the side walls are aligned with the spine section in the assembled knife 10. Suitable fasteners such as screws 26 are used to hold together the side wall sections 16, 18 and the spine section 20. The blade 14 is pivotally attached to the handle 12 near the forward end of the handle. The blade used with knife 10 may be of any known type. The blade 14 shown in the drawings comprises an elongate working portion 28 and a tang portion 30, which pivotally attaches the blade to the handle 12. Working portion 28 typically includes a sharp edge 32 and a blunt edge 34. A thumb lug 35 may be included on blade 14 to assist with opening the blade.

A blade receiving groove 36 is defined between the side walls 16, 18. The blade receiving groove 36 receives the blade 14 when it is moved to its closed position, as shown in FIG. 2.

Figure 8:
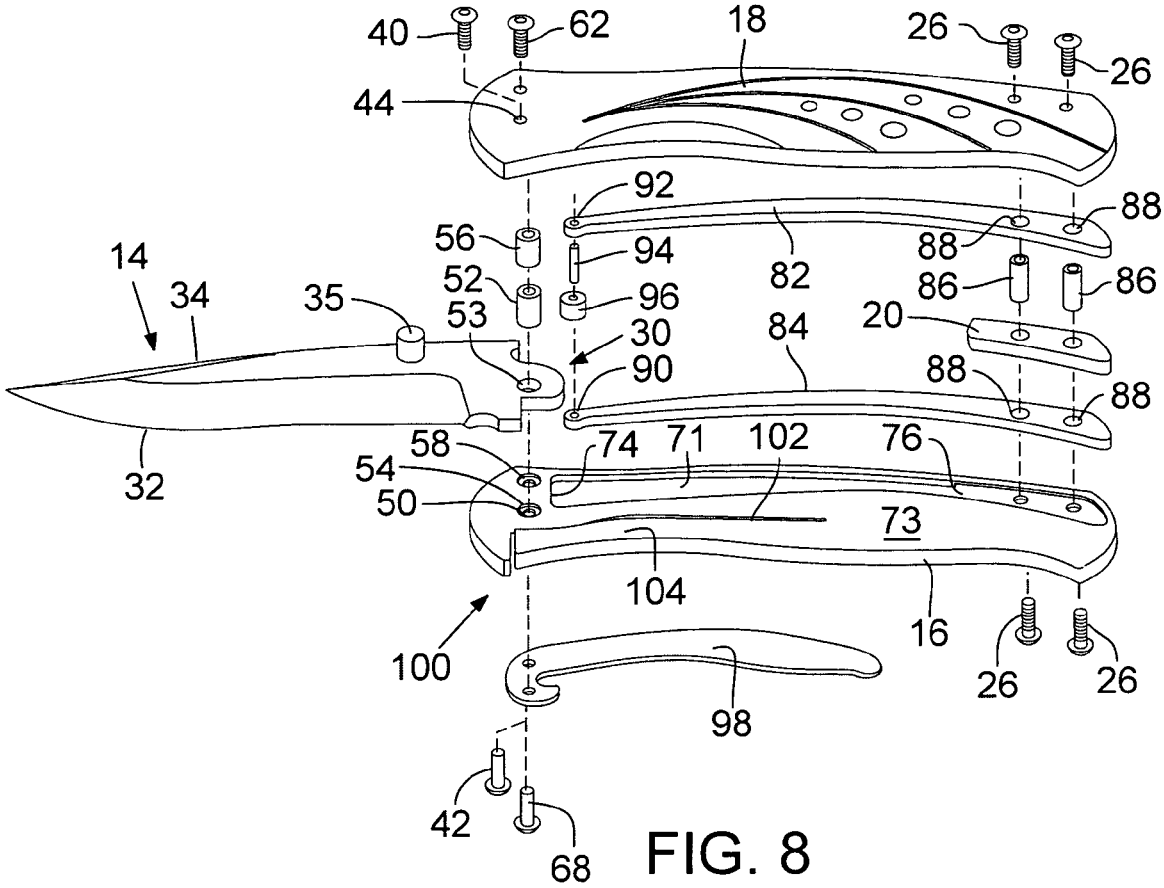
FIG. 8 is a perspective and exploded view of the knife illustrated in FIG. 1 showing the component parts thereof.

Blade 14 is attached to handle 12 such that the blade's working portion 28 extends away from the handle 12 when the blade 14 is in its open position (FIG. 1), and tang portion 30 is located within the blade receiving groove 36 between the paired handle side walls when the blade is in either the open or the closed position. That is, the tang portion 30 is always located between the side walls 16 and 18 of handle 12. The blade is pivotally attached to the handle with an annular pivot shaft, reference generally with number 38, which as detailed in FIG. 8 includes opposed screws 40 and 42 that extend through bores 44 and 50 through side walls 18 and 16, respectively, and thread into opposite ends of a threaded cylindrical bushing 52 that is received in the pivot bore 53 through tang portion 30 of blade 18. Cylindrical bushing 52 is fitted rotatably but snugly through a pivot bore 53 in tang 30 so that the bushing defines a pivot axis for the blade extending transversely with respect to the plane of the side walls. With continuing reference to FIG. 8, the opposite ends of bushing 52 are received in counter bored portions 54 of bores 44 and 50 in the respective liners. A blade stop pin 56 has its opposite ends anchored in counter bored holes 58 and 60 formed in side walls 16 and 18 and is held in place with screws 62 and 68.

Knife 10 incorporates an opening assist mechanism 100 that comprises several components. As best illustrated in FIG. 8, an elongate cavity is formed in the inner-facing surface of each of the side walls 16 and 18, although in FIG. 8 only one of the cavities is shown. Specifically, side wall 16 has an elongate cavity 71 formed therein and extending along the side wall near the upper edge thereof. Side wall 18 has an identical elongate cavity 71 formed in the same position in side wall 18 as cavity 71 in side wall 16. It will be appreciated therefore that cavities 71 in the side walls align in the assembled knife 10. The forward end of cavity 71 terminates at an edge 74.

The elongate openings 71 receive first and second spring arms, respectively, which are attached to the liners in the cavities.

A first spring arm 82 is attached to side wall 18 with screws 26, which thread into threaded bushings 86 that extend through bores 88 in the spring arm. In an identical manner, second spring arm 84 is attached to side wall 16. In FIG. 8 it may be seen that the rearward end of second spring arm 84 where bores 88 extend through the spring arm is received in cavity 71 of side wall 16. The depth of the cavity is roughly the same as the thickness of the spring arms, although the spring arms may be either slightly thicker or thinner than the depth of the cavities. Spine 20 is captured between the handle side walls, liners and spring arms with screws 26 and bushings 86 and maintains the side walls and liners in a spaced apart relationship to define blade-receiving groove 36.

A bore 90 is formed in the forward ends 92 of first and second spring arms 82 and 84. When the knife is assembled, bores 90 align and the opposite ends of a rod 94 are inserted into the bores 90. A cylindrical roller sleeve 96 with an axial hole through it is fitted over rod 94 during assembly of the knife; the axial hole through roller sleeve 96 is slightly larger than the diameter of rod 94 and the length of the sleeve is slightly less than the distance between the inner surfaces of the two spring arms. As a result, roller sleeve 96 spins easily on rod 94. Roller sleeve 96 is preferably a resilient material such as stainless steel, but may be fabricated from other metals, nylons, plastics, etc. The opposite ends of rod 94 may be press fit or swaged into bores 90, or otherwise retained therein if desired. The forward ends 92 of spring arms 82 and 84 are free, and are able to move in an up-and-down direction as shown with arrow C in FIG. 7.

Figure 4:
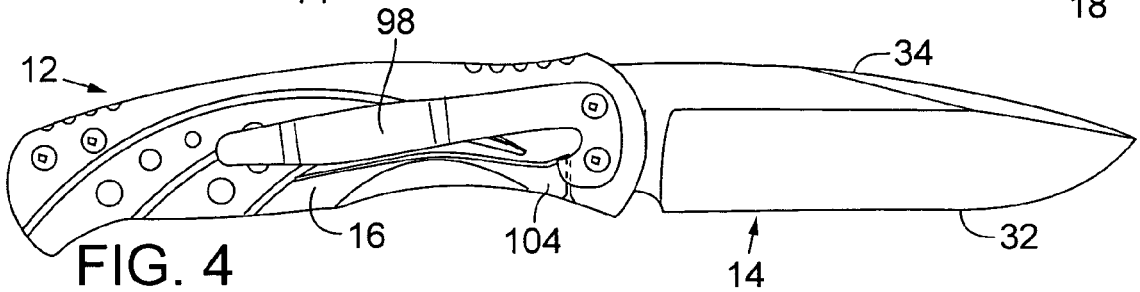
FIG. 4 is side elevation view of the knife illustrated in FIG. 3 showing the opposite side of the knife than shown in FIG. 3.

As shown in FIGS. 4 and 8, an optional spring-loaded pocket clip 98 may be included if desired—the clip is attached to the exterior surface of side wall 16.

Figure 7:
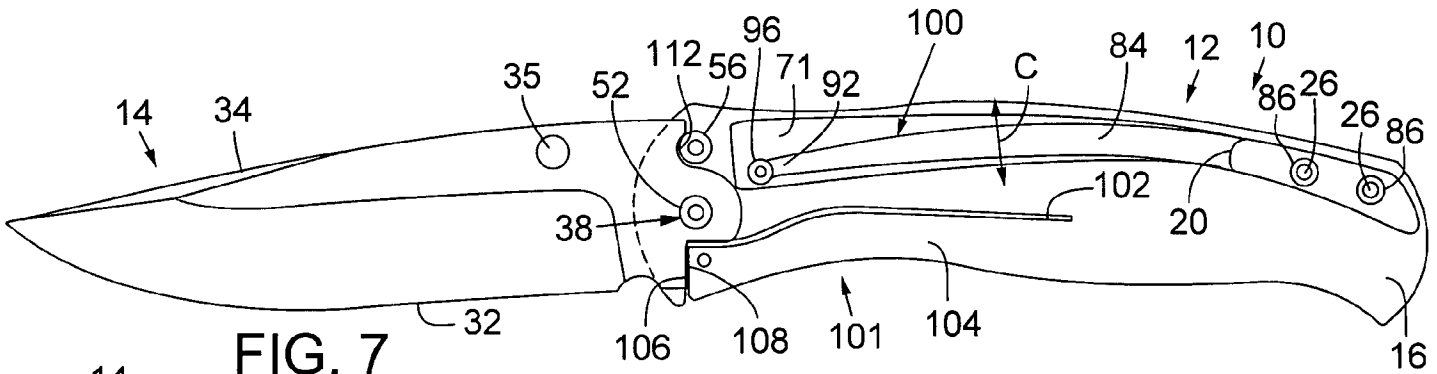
FIG. 7 is a side elevation view of the knife of FIG. 5 with the blade in the fully open and locked position.

Knife 10 further incorporates a blade locking mechanism shown generally with reference number 101 in FIG. 7. The particular blade locking mechanism shown in FIGS. 1 through 8 is a conventional "frame lock", also known as a "Monolock," which comprises an elongate L-shaped slot 102 formed in side wall 16; the slot defines a spring arm 104 that is normally biased in the inward direction, that is, toward blade-receiving groove 36. The forward end off spring arm 104 defines a blade-engaging surface 106. A cooperative locking surface 108 is formed on tang 30. When blade 14 is rotated from the closed to the open position, spring arm 104 snaps inwardly under the normal bias applied to the spring arm during fabrication so that the blade-engaging surface 106 abuts locking surface 108, as best shown in FIG. 7.

Figure 7A:
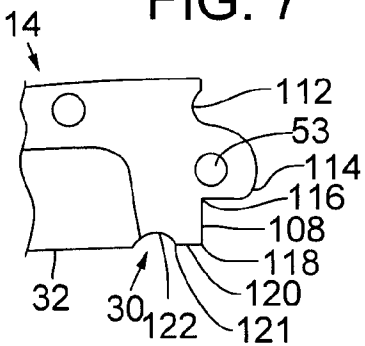
FIG. 7A is a side elevation view of an isolated portion of the tang end of the blade shown in FIG. 7.

The structure of tang 30 will now be detailed with reference to FIG. 7A. A pivot bore 53 is drilled in the approximate center of tang 30 and pivot shaft 38 extends through the pivot bore. Immediately above the pivot bore is a curved section or notch 112 that is has a radius of curvature that approximates the outer radius of blade stop pin 56. The notch 112 defines a blade stop surface; when the blade is in the fully open position, the blade stop pin is received in notch 112 so that rotation of the blade is stopped. It will be appreciated that the relative shapes of the notch and the blade stop pin need not be cylindrical, as shown, so long as the stop pin functions to stop rotation of the blade. Continuing in a clockwise direction around tang 30 from curved section 112, the edge of the tang defines a radius that terminates in a shoulder 114 where the edge of the tang turns in a forward direction and continues to a corner 116 where the edge of the tang meets the locking surface 108, which extends at approximately a 90° angle relative to the portion of the tang rearward of corner 116 so that locking surface 108 is generally perpendicular to the longitudinal axis of handle 12. The lowermost end of locking surface 108 defines a shoulder 118 where the tang again turns at approximately a 90° angle relative to the locking surface 108. The flattened section immediately forward of shoulder 118 is referred to as flattened surface 120. A semi-circular notch 122 is formed immediately forward of flattened surface 120. The point where flattened section 120 meets notch 122 is identified with reference number 121. Continuing in the forward direction from notch 122 is the sharpened edge 32 of blade 14.

Operation of the opening assist mechanism 100 will now be detailed with reference to the series of FIGS. 5, 6 and 7. It will be appreciated that in the assembled knife the spring arms 82 and 84 are positioned laterally to the sides of the blade and do not interfere with the blade as it moves from the closed to open position, and back. The spring arms thus move in planes that are laterally to the side of the plane defined by the blade and the liners do not interfere with movement of the blade. Beginning with FIG. 5, with blade 14 stowed in the closed position such that working edge 32 of blade 14 is safely held within the handle, locking surface 108 abuts blade stop pin 56 and roller sleeve 96 rests in notch 122. In this position, spring arm 82 (and spring arm 84, which is not shown in FIGS. 5, 6 and 7) is deflected from its resting position (shown in FIG. 7) and is therefore applying substantial spring force to the blade at notch 122 through roller sleeve 96. That is, the spring arms are "loaded." The direction of the force applied to the blade by the spring arms through the roller sleeve (shown generally and schematically with arrow B in FIG. 5), and the geometric relationship between the blade pivot axis, defined by pivot shaft 38, and the position of notch 122 relative to the pivot axis is such that blade 14 is held in this closed position by the spring force applied to the blade. Stated another way, the pressure applied to blade 14 by the spring arms is applied in a slightly forward direction such that the force vector from the point at which the roller sleeve contacts the tang in notch 122 is directed slightly in the forward direction, toward pivot shaft 38, causing the blade to be firmly retained closed. It will be appreciated nonetheless that the blade is under significant potential energy applied by spring arms 82 and 84, through roller sleeve 96. However, the force applied to blade 14 is sufficient to retain the blade in the closed position, and the blade will not open even when, for example, the knife is dropped, or subjected to a strong "flick of the wrist" type of motion.

Figure 6:
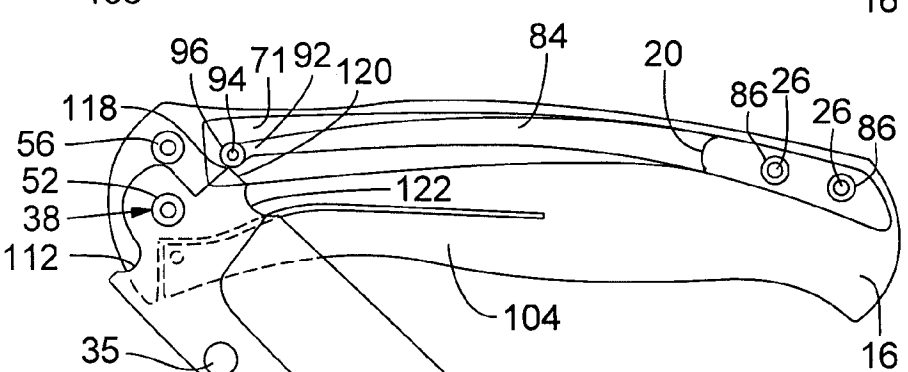
FIG. 6 is a side elevation view of the knife illustrated in FIG. 5 with the blade being rotated toward the open position.
Figure 5:
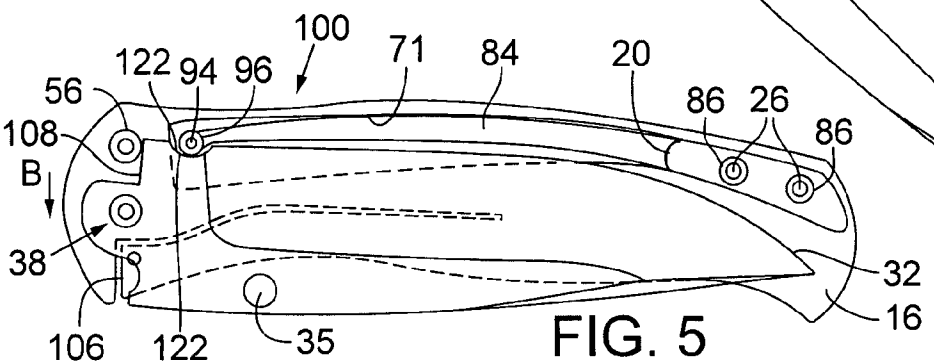
FIG. 5 is a side elevation view of the knife shown in FIG. 1 with the handle on the near side removed to illustrate the internal components of the knife with the blade in the closed position.

FIG. 6 shows the position of the blade as it is being rotated from the closed position of FIG. 5 toward the open position—shown with arrow A. Typically, the blade is rotated by the user applying pressure to thumb lug 35. As the blade is rotated toward open, roller sleeve 96 rides up the rearward curve of notch 122, which further deflects spring arms 82 and 84 to thereby load the blade with even greater potential energy. The roller sleeve travels across flattened section 120 and over shoulder 118. As noted, the point where notch 122 meets flattened section 120 is identified with reference number 121. This is the top dead center point.

As the roller sleeve moves over the point 121 where notch 122 meets flattened section 120 the spring arms are exerting the maximum pressure against the blade. It will be appreciated that force must be applied to blade 14 to move it from the closed position to the position shown in FIG. 6, since the resilient biasing force of spring arms 82 and 84 is acting against this motion, essentially urging the blade back into the closed position.

Point 121 represents an apex or top-dead-center position for roller sleeve 96 as it rides over the tang 30 as the blade is opened. At this top-dead-center position 121, the spring force applied against blade 14 by spring arms 82 and 84 is at a maximum.

As blade 14 is moved further in the clockwise direction in FIG. 6, the roller sleeve 96 rides over the top dead center point (point 121) and when the center point of roller sleeve 96 moves just past the top-dead-center point 121, roller sleeve is past the top-dead-center point and the spring force provided by the spring arms 82 and 84, which are now moving quickly into their resting positions, drives blade 14 quickly in the clockwise direction toward the open position. This spring force acting on the blade imparts rotational kinetic energy to the blade, and any and all pressure applied by the user to thumb lug 35 may be released once the roller sleeve passes the top-dead-center point, and the blade is automatically driven into the open position under the spring force of the spring arms. Thus, as the spring arms 82 and 84 snap to their resting, or "unloaded" positions, the blade is quickly and positively driven to the open position. Once the roller sleeve passes over the apex defined by shoulder 118, the roller sleeve is no longer in contact with the blade and the blade is rotating freely toward the open position. The spring arms impart sufficient energy to the blade that the inertia of the blade carries it into the open position.

There is therefore a threshold point in the pivotal rotation of blade 14 from the closed to the open position beyond which the spring arms 82 and 84 supply all of the energy necessary to move the blade into the fully open (and locked) position. In the preferred embodiment, the threshold position is the point in the rotation of the blade where the roller sleeve moves over the top dead center point 121 to thereby forcibly drive the blade into the fully open position in the manner described. If the blade is not rotated to this threshold point, the spring arms cause the blade to remain in the closed position.

Referring now to FIG. 7 it may be seen that with blade 14 in the fully opened position, spring arms 82 and 84 have moved into their resting positions, that is, positions where the springs are not loaded. The forward rotation of blade 14 is stopped when shoulder curved section 112 of tang portion 30 abuts blade stop pin 56. The stop pin provides a strong stop mechanism for preventing the blade from further movement in the clockwise direction.

As noted earlier, knife 10 includes a frame lock locking mechanism that is incorporated into side wall 16 and which is defined by spring arm 104 that has a forward locking surface 106 and which is normally biased inwardly, toward blade-receiving groove 36. As shown in FIG. 7, when blade 14 is in the fully open or extended position, the forward end of spring arm 104 and thus engaging surface 106 moves inwardly toward the blade until the blade-engaging surface snaps behind blade locking surface 108 on tang 30. As noted above, the frame locking mechanism described herein is a standard mechanism. With the blade in the open position, stop pin 56 abuts curved section 112. It will be understood by those skilled in the art that in addition to the liner locking mechanism just described, numerous other known mechanisms may be used, including for example lock-back structures and locking pins that extend transverse to the blade.

Blade 14 is moved from the fully open position to the closed position in essentially the reverse order of the opening procedure described above. First, the frame locking mechanism that locks blade 14 in the extended position is released by pushing spring arm 104 in the outward direction, that is, in the direction away from blade-receiving groove 36 until the blade-engaging surface 106 disengages from blade locking surface 108 of tang portion 30. Once the spring arm 104 clears the tang, the blade may be freely rotated about the pivot axis defined by shaft 38 toward the closed position—counterclockwise in FIGS. 5, 6 and 7. The blade freely rotates in the counterclockwise direction until the roller sleeve 96 begins to ride up the blade locking surface 108 on tang 30 near shoulder 118. Once the roller sleeve touches the tang near shoulder 118, force must be applied to the blade to continue rotation of the blade against the biasing force applied by spring arms 82 and 84. As described above, the roller sleeve rides over shoulder 118, this time in the opposite direction, lifting spring arms 82 and 84 until the roller sleeve moves just past the top-dead-center point of apex 121. Once roller sleeve 96 passes this threshold point, the closing force supplied by spring arms 82 and 84 pulls blade 14 into the fully closed position and retains the blade snugly in this position with roller sleeve resting in notch 112.

As noted above, roller sleeve 96 rotates freely on rod 94. Because the roller sleeve is able to spin as the sleeve rides over the tang 30 as described above, the frictional forces between the sleeve and the tang are decreased. It will nonetheless be appreciated that the roller sleeve, while used in the illustrated embodiment, is considered to be optional and that a pin may be used without a roller sleeve with equivalent functionality.

Because the foregoing invention utilizes a spring arm positioned on each side of the blade, the driving force applied to the blade by the roller sleeve is applied in the same plane as the plane in which the blade pivots, even though the springs are outside of this blade pivot plane. This structure results in a rapid opening mechanism that does not tend to drive the blade to one side or the other, as might occur if for example only one spring arm were used.

A second illustrated embodiment of a folding knife 10 incorporating an opening assist mechanism according to the present invention is illustrated in FIGS. 9 through 16. The folding knife 10 shown in this series of drawing figures is similar to that shown in FIGS. 1 through 8; however, the embodiment of FIGS. 9 through 16 utilizes liners between the blade and the handle side walls, and the spring arms that comprise the opening mechanism are attached to the liners. It is to be understood that like structural features already described with respect to FIGS. 1 through 8 are assigned the same reference numbers in the description that follows with respect to the other drawings.

Figure 9:
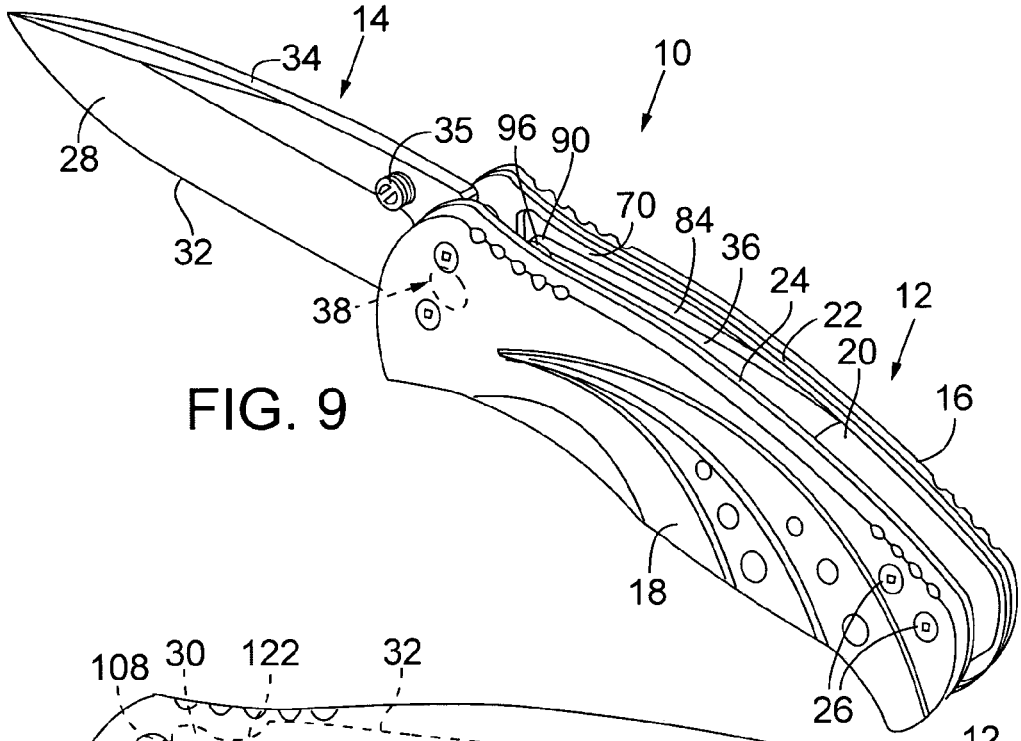
FIG. 9 is perspective view of a second illustrated embodiment of a knife incorporating an opening assist mechanism according to the present invention. The knife shown in FIGS. 9 through 15 is a semi-automatic knife that utilizes liners between the side walls.

Beginning with reference to FIG. 9, folding knife 10 includes an elongate handle 12, and a blade 14 that is pivotally attached to the handle at the forward end of the handle. Handle 12 of knife 10 comprises a pair of oppositely located side wall sections, generally indicated at 16, 18, that are parallel with each other and held spaced apart from one another by a spine member or spacer 20 which is located between the side wall sections along their upper long edges and which curves around the rearward end of the handle. A liner member 22 is disposed inwardly alongside side wall section 16. Similarly, the other side wall section 18 has a liner member 24 disposed inwardly alongside the side wall.

The liners 22 and 24 are preferably fabricated from resilient steel such as a spring steel or titanium.

Figure 10:
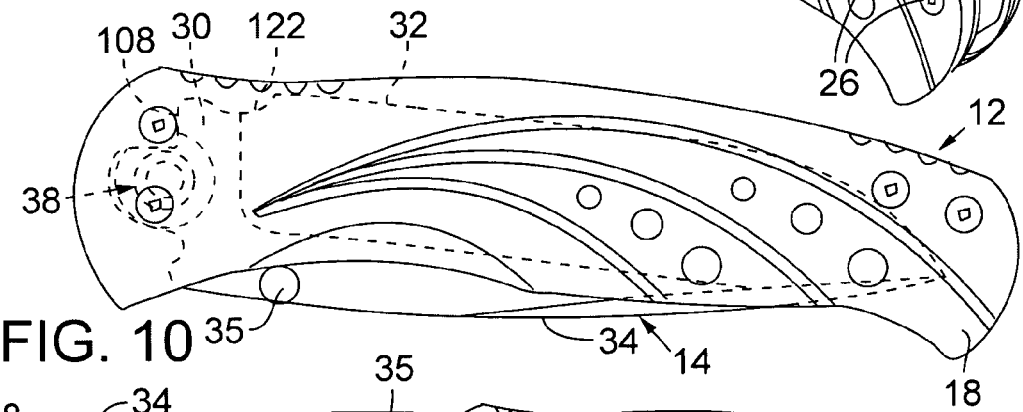
FIG. 10 is side elevation view of the knife illustrated in FIG. 9 with the blade shown in dashed lines stowed in the closed position.
Figure 11:
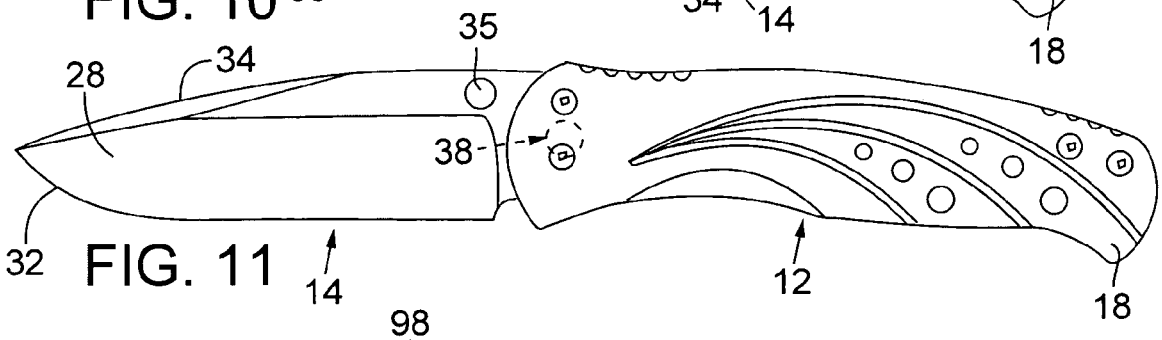
FIG. 11 is side elevation view similar to FIG. 10 with the blade in the open position.
Figure 12:
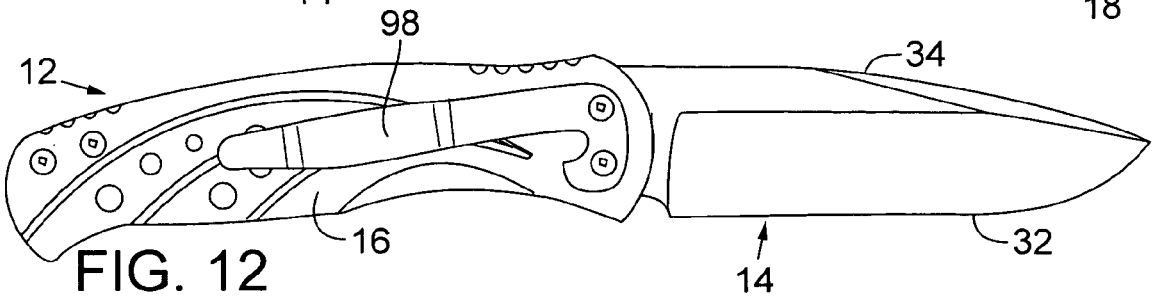
FIG. 12 is side elevation view of the knife illustrated in FIG. 9 showing the opposite side of the knife than shown in FIG. 11.

When handle 12 is assembled, the spine 20 is disposed between the liner members 22 and 24 and extends along the upper edge margins of the liners and side walls 16 and 18. As illustrated in FIGS. 9 and 10, the side walls are aligned with the liner sections and the spine section in the assembled knife 10. Suitable fasteners such as screws 26 are used to hold together the side wall sections 16, 18, the liner members 22 and 24, and the spine section 20. The blade 14 is pivotally attached to the handle 12 near the forward end of the handle. The blade 14 shown in the drawings comprises an elongate working portion 28 and a tang portion 30, which pivotally attaches the blade to the handle 12. Working portion 28 typically includes a sharp edge 32 and a blunt edge 34. A thumb lug 35 may be included on blade 14 to assist with opening the blade.

A blade receiving groove 36 is defined between the side walls 16, 18 and their associated liner members 22 and 24, respectively. The blade receiving groove 36 receives the blade 14 when it is moved to its closed position, as shown in FIG. 10.

Figure 16:
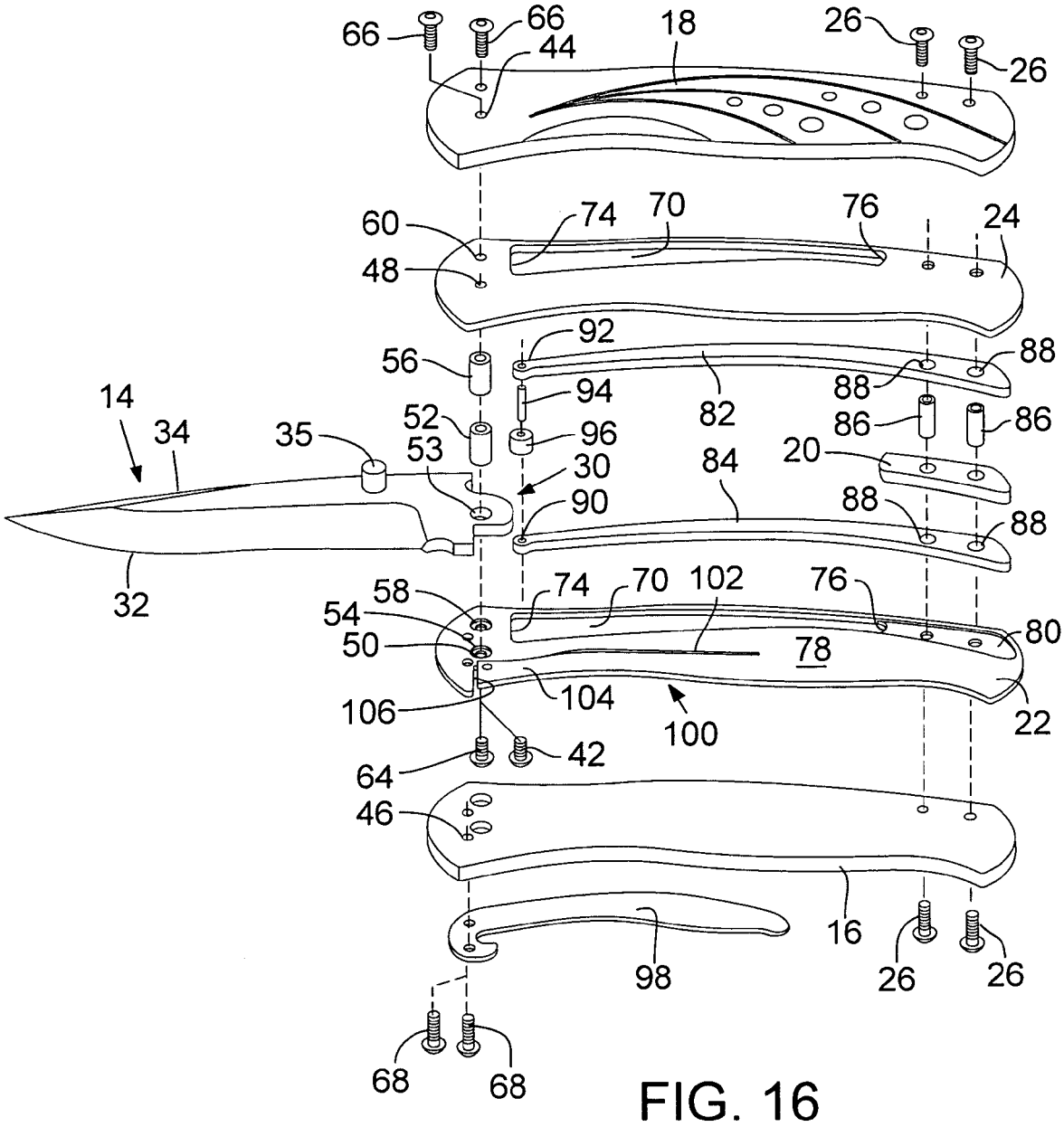
FIG. 16 is a perspective and exploded view of the knife illustrated in FIG. 9 showing the component parts thereof.

Blade 14 is attached to handle 12 such that the blade's working portion 28 extends away from the handle 12 when the blade 14 is in its open position (FIG. 9), and tang portion 30 is located within a blade receiving groove 36 defined between the paired handle side walls and liners when the blade is in either the open or the closed position—the tang portion 30 is always located between the liners 22 and 24 of handle 12. The blade is pivotally attached to the handle with an annular pivot shaft, reference generally with number 38, which as detailed in FIG. 16 includes opposed screws 40 and 42 that extend through aligned bores 48 and 50 drilled through first and second liners 24 and 22, respectively, and thread into opposite ends of a threaded cylindrical bushing 52 that is received in the pivot bore 53 through tang portion 30 of blade 18. Cylindrical bushing 52 is fitted rotatably but snugly through a pivot bore 53 in tang 30 so that the bushing defines a pivot axis for the blade extending transversely with respect to the plane of the side walls. With continuing reference to FIG. 16, the opposite ends of bushing 52 are received in counter bored portions 54 in the respective liners. A blade stop pin 56 has its opposite ends anchored in counter bored holes 58 and 60 formed in liners 22 and 24 and is held in place with screws 62 and 64. The liners 22 and 24 are held in place against the respective handle halves with fasteners such as screws 66 and 68, which thread through holes in the side walls and into threaded holes in the liners.

The opening assist mechanism 100 used in the embodiment of FIGS. 9 through 16 is best illustrated in FIG. 16. An elongate opening is formed in each of the liners 22 and 24. Specifically, liner 22 has an elongate opening 70 formed therein and extending along the liner near the upper edge thereof. Liner 24 has an identical elongate opening 72 formed in the same position in liner 24 as opening 70 in liner 22. It will be appreciated therefore that openings 70 and 72 align in the assembled knife 10. The forward end of opening 70 terminates at an edge 74 and the rearward end terminates at rearward edge 76. With specific reference to liner 22, the inner-facing surface 78 of liner 22 has a cavity 80 formed therein rearward of rearward edge 76. Although not visible in FIG. 16, an identical cavity is formed in the inner-facing surface of liner 24. The elongate openings 70 receive first and second spring arms, respectively, which are attached to the liners in the cavities.

A first spring arm 82 is attached to liner 24 with screws 26, which thread into threaded bushings 86 that extend through bores 88 in the spring arm. In an identical manner, second spring arm 84 is attached to liner 22. In FIG. 16 it may be seen that the rearward end of second spring arm 84 where bores 88 extend through the spring arm is received in cavity 80 of liner 22. The depth of the cavity is roughly the same as the thickness of the spring arms, although the spring arms may be either slightly thicker or thinner than the depth of the cavities. Spine 20 is captured between the handle side walls, liners and spring arms with screws 26 and bushings 86 and maintains the side walls and liners in a spaced apart relationship to define blade-receiving groove 36.

A bore 90 is formed in the forward ends 92 of first and second spring arms 82 and 84. When the knife is assembled, bores 90 align and the opposite ends of a rod 94 are inserted into the bores 90. A roller sleeve 96 with an axial hole through it is fitted over rod 94 during assembly of the knife; the axial hole through roller sleeve 96 is slightly larger than the diameter of rod 94 and the length of the sleeve is slightly less than the distance between the inner surfaces of the two spring arms. As a result, roller sleeve 96 spins easily on rod 94. Roller sleeve 96 is preferably a resilient material such as stainless steel, but may be fabricated from other metals, nylons, plastics, etc. The opposite ends of rod 94 may be press fit or swaged into bores 90, or otherwise retained therein. The forward ends 92 of spring arms 82 and 84 are free, and are able to move in an up-and-down direction as shown with arrow C in FIG. 15.

As shown in FIG. 16, an optional spring-loaded pocket clip 98 may be included if desired—the clip is attached to the exterior surface of side wall 16.

Figure 15:
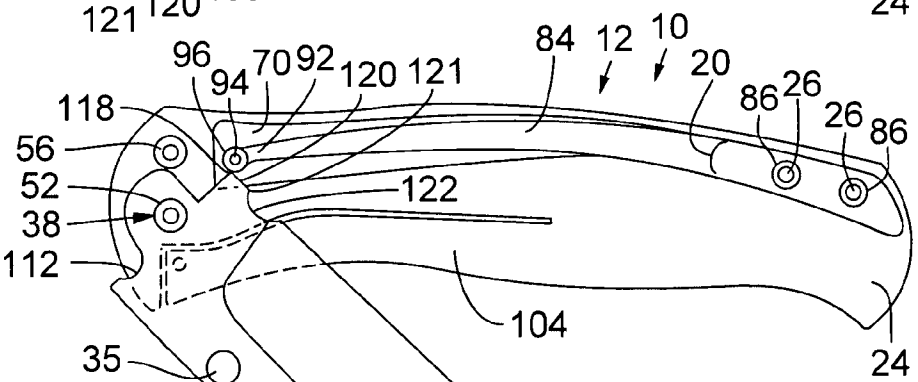
FIG. 15 is a side elevation view of the knife illustrated in FIG. 13 with the blade being rotated toward the open position.

Knife 10 further incorporates a blade locking mechanism shown generally with reference number 101 in FIG. 15. The particular blade locking mechanism shown in the drawings is a conventional "liner lock," which comprises an elongate L-shaped slot 102 formed in liner 22; the slot defines a spring arm 104 that is normally biased in the inward direction, that is, toward blade-receiving groove 36. The forward end off spring arm 104 defines a blade-engaging surface 106. A cooperative locking surface 108 is formed on tang 30. When blade 14 is rotated from the closed to the open position, spring arm 104 snaps inwardly under the normal bias applied to the spring arm during fabrication so that the blade-engaging surface 106 abuts locking surface 108, as best shown in FIG. 15.

Figure 14:
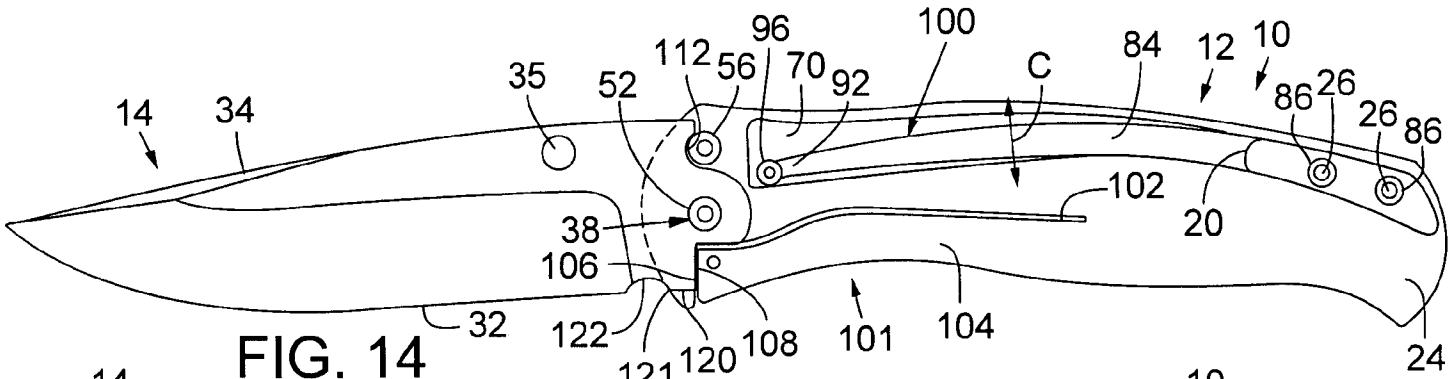
FIG. 14 is a side elevation view of the knife of FIG. 13 with the blade in the fully open and locked position.
Figure 14A:
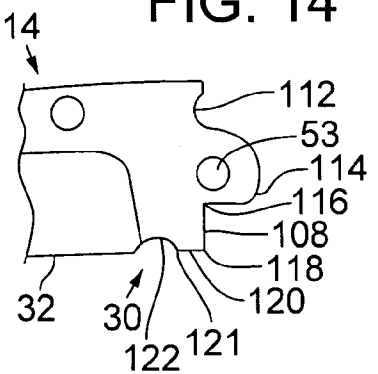
FIG. 14A is a side elevation view of an isolated portion of the tang end of the blade shown in FIG. 14.

The structure of tang 30 shown in FIG. 14A is identical to that described above with respect to FIG. 7A.

Operation of the opening assist mechanism 100 will now be detailed with reference to the series of FIGS. 13, 14 and 15. It will be appreciated that in the assembled knife the spring arms 82 and 84 are positioned laterally to the sides of the blade and do not interfere with the blade as it moves from the closed to open position, and back. The spring arms thus move in planes that are laterally to the side of the plane defined by the blade and the liners do not interfere with movement of the blade. Beginning with FIG. 13, with blade 14 stowed in the closed position such that working edge 32 of blade 14 is safely held within the handle, locking surface 108 abuts blade stop pin 56 and roller sleeve 96 rests in notch 122. In this position, spring arm 82 (and spring arm 84, which is not shown in FIGS. 13, 14 and 15) is deflected from its resting position (shown in FIG. 15) and is therefore applying substantial spring force to the blade at notch 122 through roller sleeve 96. The spring arms are thus "loaded." The direction of the force applied to the blade by the spring arms through the roller sleeve (shown generally and schematically with arrow B in FIG. 13), and the geometric relationship between the blade pivot axis, defined by pivot shaft 38, and the position of notch 122 relative to the pivot axis is such that blade 14 is held in this closed position by the spring force applied to the blade. The pressure applied to blade 14 by the spring arms is applied in a slightly forward direction such that the force vector from the point at which the roller sleeve contacts the tang in notch 122 is directed slightly in the forward direction, toward pivot shaft 38, causing the blade to be firmly retained closed. As noted above, in this position the blade is under significant potential energy applied by spring arms 82 and 84, through roller sleeve 96. However, the force applied to blade 14 is sufficient to retain the blade in the closed position, and the blade will not open even when, for example, the knife is dropped, or subjected to a strong "flick of the wrist" type of motion.

Figure 13:
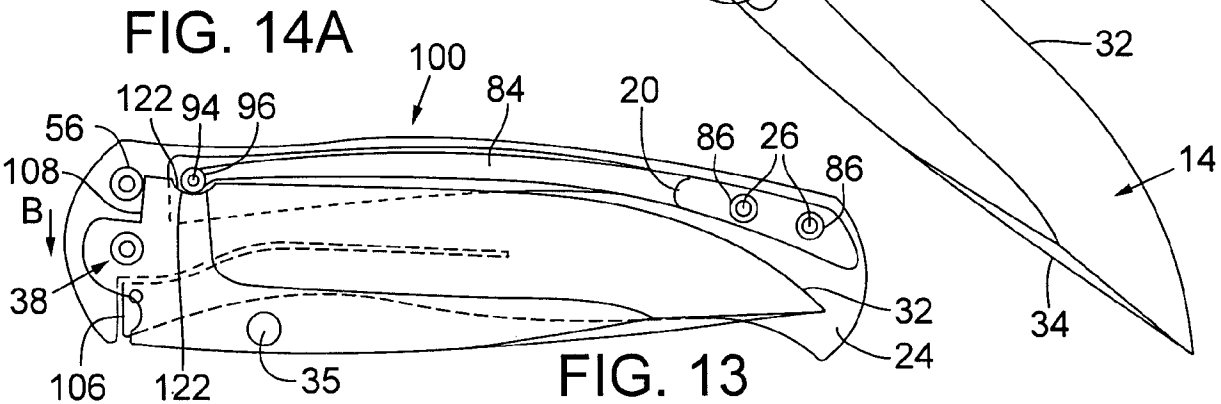
FIG. 13 is a side elevation view of the knife shown in FIG. 9 with the liner and handle on the near side removed to illustrate the internal components of the knife with the blade in the closed position.

FIG. 15 shows the position of the blade as it is being rotated from the closed position of FIG. 13 toward the open position. As the blade is rotated toward open, roller sleeve 96 rides up the rearward curve of notch 122, which further deflects spring arms 82 and 84 to thereby load the blade with even greater potential energy. The roller sleeve travels across flattened section 120 and over shoulder 118. The point where notch 122 meets flattened section 120 is identified with reference number 121. This is the top dead center point.

As the roller sleeve moves over the point 121 where notch 122 meets flattened section 120 the spring arms are exerting the maximum pressure against the blade. It will be appreciated that force must be applied to blade 14 to move it from the closed position to the position shown in FIG. 14, since the resilient biasing force of spring arms 82 and 84 is acting against this motion, essentially urging the blade back into the closed position. As noted, point 121 represents an apex or top-dead-center position for roller sleeve 96 as it rides over the tang 30 as the blade is opened. At this top-dead-center position 121, the spring force applied against blade 14 by spring arms 82 and 84 is at a maximum.

As blade 14 is moved further in the clockwise direction in FIG. 14, the roller sleeve 96 rides over the top dead center point (point 121) and when the center point of roller sleeve 96 moves just past the top-dead-center point 121, roller sleeve is past the top-dead-center point and the spring force provided by the spring arms 82 and 84, which are now moving quickly into their resting positions, drives blade 14 quickly in the clockwise direction toward the open position. The spring force acting on the blade imparts rotational kinetic energy to the blade, and any and all pressure applied by the user to thumb lug 35 may be released once the roller sleeve passes the top-dead-center point, and the blade is automatically driven into the open position under the spring force of the spring arms. Thus, as the spring arms 82 and 84 snap to their resting, or "unloaded" positions, the blade is quickly and positively driven to the open position. Once the roller sleeve passes over the apex defined by shoulder 118, the roller sleeve is no longer in contact with the blade and the blade is rotating freely toward the open position. The spring arms impart sufficient energy to the blade that the inertia of the blade carries it into the open position.

In the preferred embodiment, the threshold position for driving the blade to the open position is the point in the rotation of the blade where the roller sleeve moves over top dead center point 121 to thereby forcibly drive the blade into the fully open position in the manner described. If the blade is not rotated to this threshold point, the spring arms cause the blade to remain in the closed position.

With blade 14 in the fully opened position (FIG. 14), spring arms 82 and 84 have moved into their resting positions where the springs are not loaded. The forward rotation of blade 14 is stopped when shoulder curved section 112 of tang portion 30 abuts blade stop pin 56. The stop pin provides a strong stop mechanism for preventing the blade from further movement in the clockwise direction.

The liner locking mechanism used in the embodiment of FIGS. 9 through 16 functions in an identical manner to the frame lock described above, except the locking arm is a part of a liner rather than a side wall. The liner locking mechanism that is incorporated into liner 22 is defined by spring arm 104 that has a forward locking surface 106 and which is normally biased inwardly, toward blade-receiving groove 36. As shown in FIG. 14, when blade 14 is in the fully open or extended position, the forward end of spring arm 104, and thus engaging surface 106 moves inwardly toward the blade until the blade-engaging surface snaps behind blade locking surface 108 on tang 30. With the blade in the open position, stop pin 56 abuts curved section 112.

Blade 14 is moved from the fully open position to the closed position by first releasing the blade lock by pushing spring arm 104 in the outward direction away from blade-receiving groove 36 until the blade-engaging surface 106 disengages from blade locking surface 108 of tang portion 30. Once the spring arm 104 clears the tang, the blade may be freely rotated about the pivot axis defined by shaft 38 toward the closed position—counterclockwise in FIGS. 13, 14 and 15. The blade freely rotates in the counterclockwise direction until the roller sleeve 96 begins to ride up the blade locking surface 108 on tang 30 near shoulder 118. Once the roller sleeve touches the tang near shoulder 118, force must be applied to the blade to continue rotation of the blade against the biasing force applied by spring arms 82 and 84. The roller sleeve rides over shoulder 118, this time in the opposite direction, lifting spring arms 82 and 84 until the roller sleeve moves just past the top-dead-center point 121. Once roller sleeve 96 passes this threshold point, the closing force supplied by spring arms 82 and 84 pulls blade 14 into the fully closed position and retains the blade snugly in this position with roller sleeve resting in notch 112.

Those having ordinary skill in the art to which the present invention pertains will readily appreciate that the opening assist mechanism described herein and shown in the drawing figures may be structurally modified in various respects. Certain alternative embodiments are described below.

Figure 19:
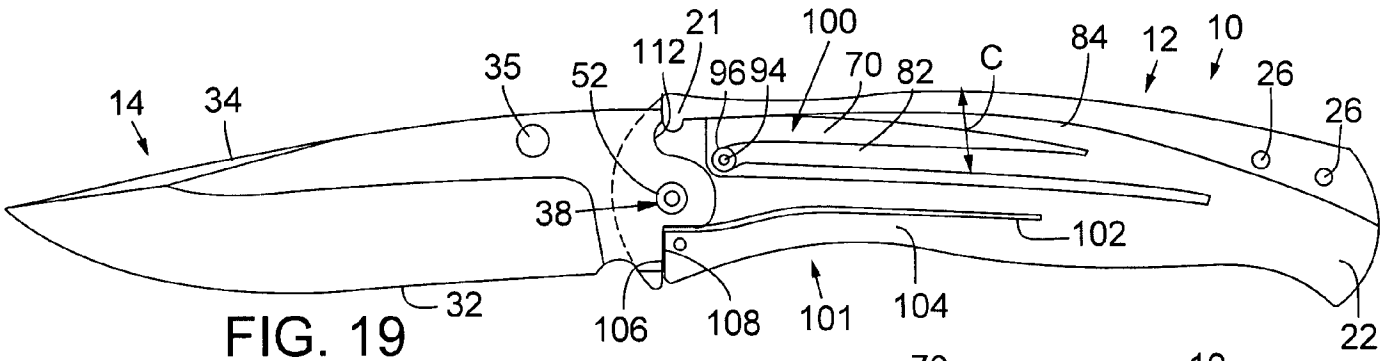
FIG. 19 is a side elevation view of the knife of FIG. 17 with the blade in the fully open and locked position.
Figure 18:
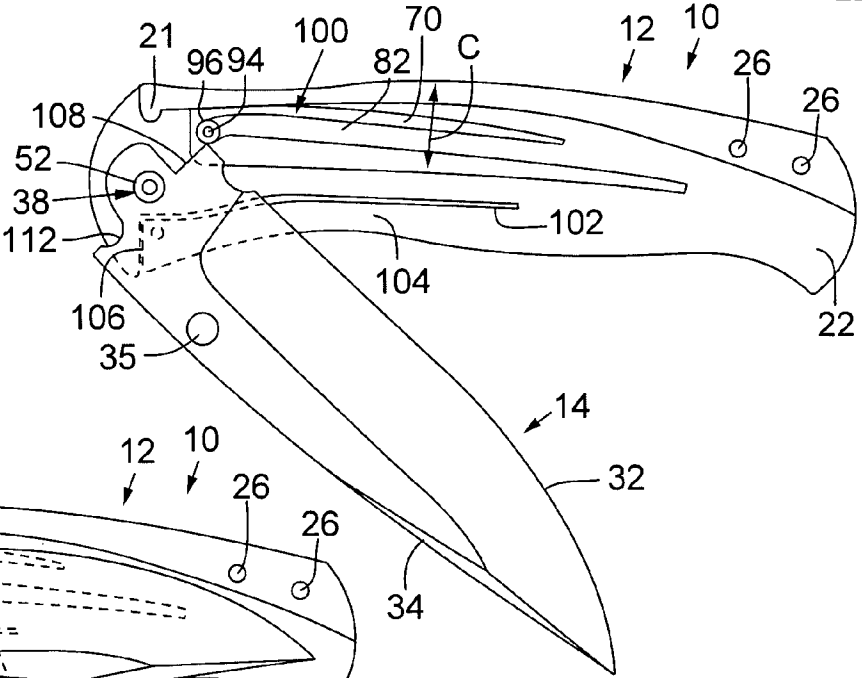
FIG. 18 is a side elevation view of the knife illustrated in FIG. 17 with the blade being rotated toward the open position.
Figure 17:
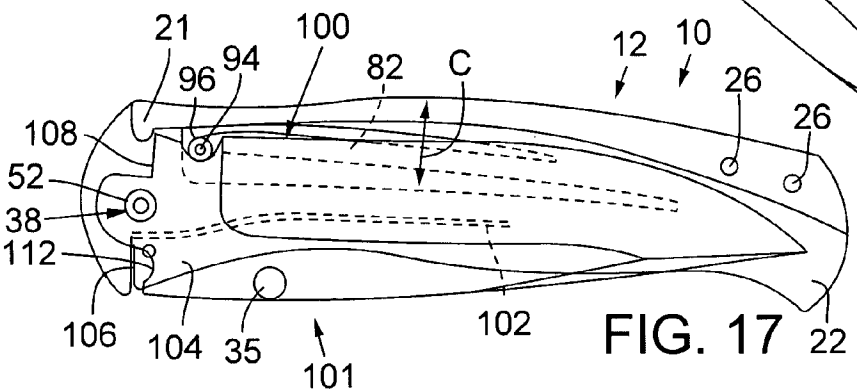
FIG. 17 is side elevation view similar to FIG. 9 of a knife utilizing a third illustrated alternative embodiment of the opening assist mechanism according to the present invention.

The series of drawing FIGS. 17 through 19 are analogous to FIGS. 13 through 15 except they illustrate a knife 10 in which the spring arms 82 and 84 (spring arm 84 is not shown in this series of drawings) are formed as an integral part of the liner members rather than as a separate piece as with the embodiment of FIGS. 13 through 15. With reference first to FIGS. 17 through 19, it may be seen that spring arm 82 is formed as an integral part of liner 22. That is, the liner is a unitary piece that is cut to define the spring arm. The cut-out in liner 22 that defines the spring arm defines and elongate opening 70 in which the spring arm 82 is capable of moving in an up-and-down manner as described above, and as illustrated with arrow C. Likewise, liner 22 includes an identical elongate slot. The liner locking mechanism 101 of FIGS. 17 through 19 is identical in function to that described above with respect to the knives of FIGS. 1 and 9.

Other than the differences described herein, the operative structural features of the knife shown in FIGS. 17 through 19 are identical to those shown in FIGS. 1 through 16, including for example the tang 30 of blade 14 and the roller sleeve 96, etc.

One structural difference between the embodiment of FIG. 17 and that of FIG. 9 is that in FIG. 17 the spine 20 extends completely along the upper edge of knife 10 between the handle side walls and the liners. The forward end 21 is positioned above pivot shaft 38 and functions as the blade stop when the blade is in the open position.

The opening assist mechanism 100 shown in FIGS. 17, 18 and 19 functions identically to that described with respect to FIGS. 1 through 16, and the description above with respect specifically to FIGS. 13 through 15 is equally applicable to describe the operation of the knife of FIG. 17.

Figure 20:
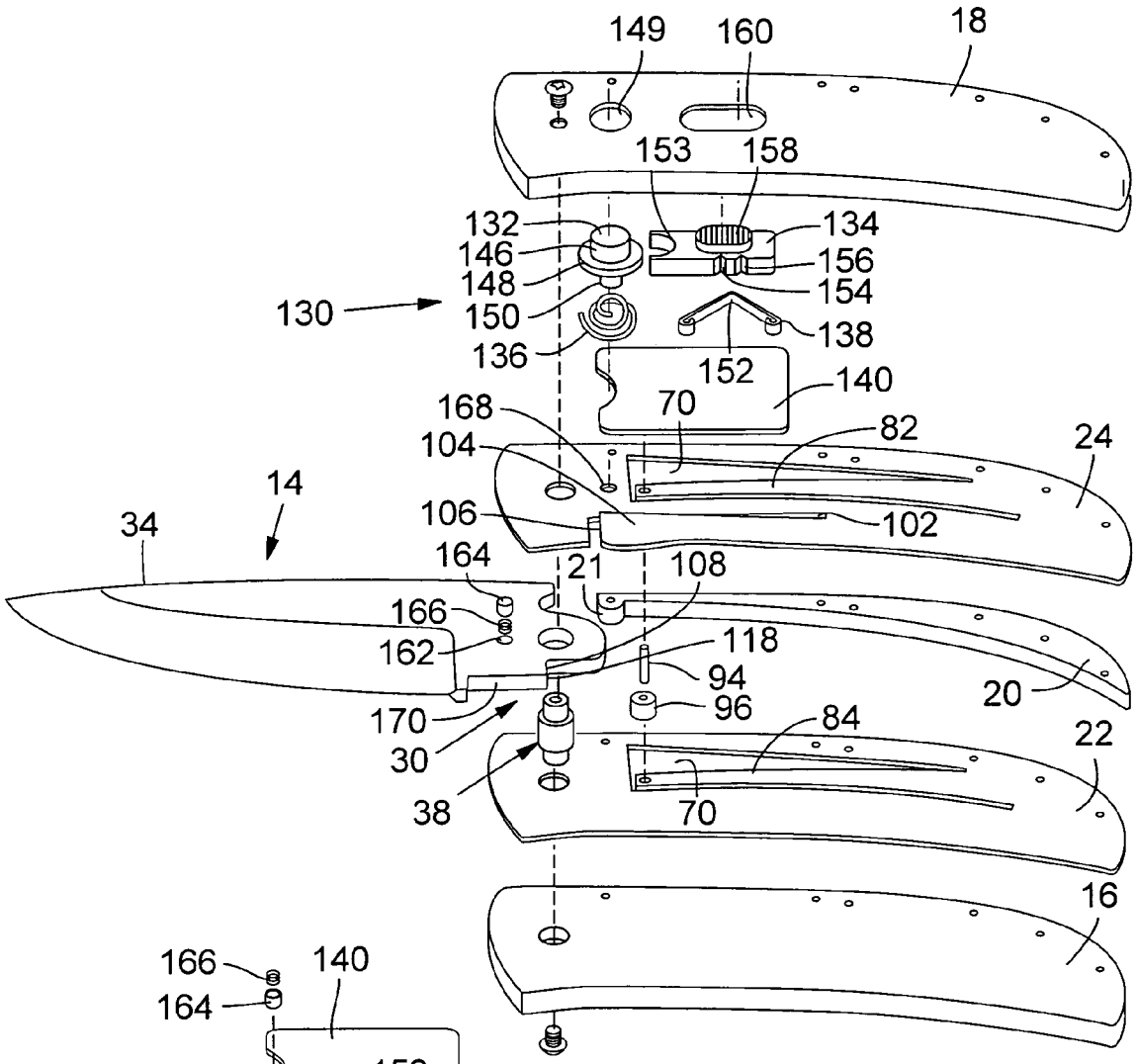
FIG. 20 is a perspective and exploded view of a knife utilizing an opening assist mechanism according to the present invention, in which the mechanism is embodied in an automatic opening knife.

Yet another alternative embodiment of a knife 10 incorporating an opening assist mechanism according to the present invention is shown in FIGS. 20 through 25. However, while the opening assist mechanism 100 is functionally identical to those described above, the knife in FIGS. 20 through 25 is an automatic knife rather than a semi-automatic knife. The knife 10 shown in FIG. 20 is thus operated with a trigger mechanism 130 that when activated fires the blade into the open position. The trigger mechanism will be detailed below. First, however, it will be appreciated from the description above and from the drawings that the opening assist mechanism used in the knife 10 of FIG. 20 is the same as that shown in FIGS. 17 through 19, with the liners having integrally formed spring arms 82 and 84. However, the structure of the tang 30 is somewhat different to accommodate the automatic opening feature. Specifically, tang 30 lacks a notch 122 and instead has a flattened surface 170 forward of shoulder 118 and blade locking surface 108. The tang of the blade further includes a plunger bore 162, the purpose of which is explained below. When the blade 14 is in the closed position, roller sleeve 96 presses against flattened surface 170. Because there is no notch in the tang into which the sleeve rests, the blade 14 will not remain in the closed position without the trigger mechanism 130. Thus, absent the trigger, the spring force that is applied against the blade when it is in the closed position would constantly force blade 14 into the open position—the blade could not be retained in the closed position.

Figure 21:
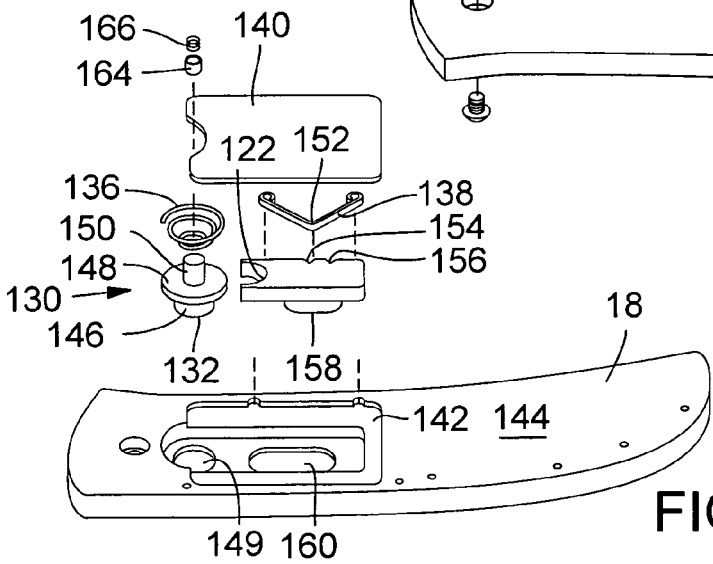
FIG. 21 is an isolated view of some of the trigger and latching components of the knife shown in FIG. 20.

Trigger mechanism 130 comprises a trigger button 132, a safety latch 134, a coil spring 136, a V-shaped leaf spring 138 and a retainer plate 140 that retains the entire mechanism 130 in a cavity 142 formed in interior surface 144 of handle side wall 18 (see FIG. 21). Trigger button 132 has an upper portion 146 that extends through an opening 149 in side wall 18. A retaining ring 148 is larger in diameter than opening 149 and retains trigger button in the cavity 142. Coil spring 136 encircles a lower plunger 150 that extends from trigger button 132 opposite upper portion 146. Safety latch 134 is configured to be longitudinally sidable (generally along the axis defined by the longitudinal axis of handle 18) and has a forward portion with a semi-circular cut out 153 that has the same diameter as the diameter of upper portion 146 of trigger button 132. As best seen in FIG. 21, when the trigger mechanism 130 is assembled, each of the components just mentioned are captured in cavity 142 with retainer plate 140. When this is done, coil spring 136 applies spring pressure against trigger button 132, urging the button outwardly. Travel of the button stops when retainer ring 148 contacts the inner surface of the cavity. V-shaped leaf spring 138 is captured between safety latch 134 and the side wall of cavity 142 so that the apex 152 of the spring is pressed against the safety latch, and the legs of the spring are captured in notches in the cavity. The latch 134 has two notches, 154 and 156 into which apex 152 fits. The latch further includes an activation knob 158 that extends through an elongate opening 160 in side wall 18 that allows the safety latch to be moved in a forward and rearward direction between a locked position and an unlocked position.

A coil spring 166 is captured in a blind hole 162 formed in blade 14, and a tubular cap member 164, which has one open end and one closed domed end is placed over coil spring 166 in the assembled knife. The spring pushes the cap member away from blade 14 and into an opening 168 in liner 24, as detailed below.

Figure 22:
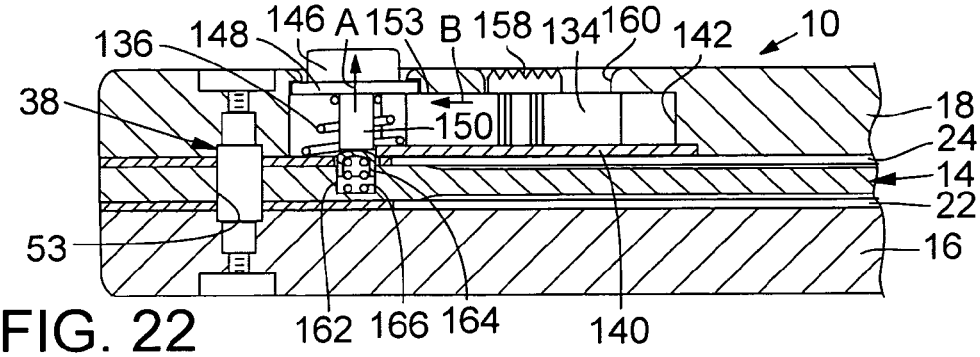
FIG. 22 is a partial sectional view of automatic opening knife shown in FIG. 20, illustrating the structure and function of the trigger and latching mechanisms when the blade is in the closed and locked position.

With reference now to FIG. 22, the knife 10 is illustrated with the blade 14 in the closed position. In this position, the spring arms 82 and 84 are exerting constant biasing force against the blade, urging the blade toward the open position. However, the trigger mechanism 130 is in the locked position. Specifically, trigger button 132 has been pushed outwardly under the normal spring force of coil spring 136 until retaining ring 148 contacts the inner surface of handle 18. In this position, spring 166 is pushing cap member 164 into opening 168 of liner 24; the domed upper surface of the cap member 164 is being urged against plunger 150. With the cap member received in opening 168 of liner 24, the blade cannot move from the locked position. That is, the cap member, which is partially received in opening 162 of blade 14 and opening 168 of liner 24 prevents rotation of the blade because it is blocking rotation of the blade. Safety latch 134 is slid forwardly (arrow B) so that semi-circular cut out 153 partially encircles upper portion 146 of trigger button 132, thereby retaining the trigger button in the position shown in FIG. 22. In other words, the forward portion of the safety latch physically prevents trigger button 132 from being moved from the latch position.

Figure 24:
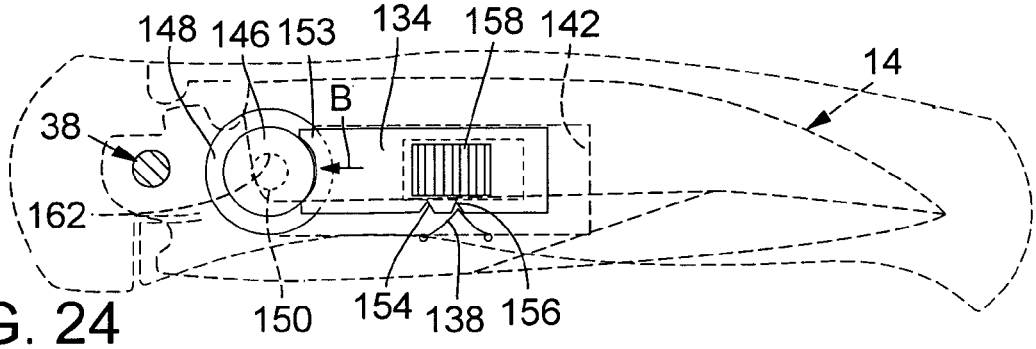
FIG. 24 is a side elevation view of the trigger mechanism used in the automatic knife of FIG. 20, illustrating the trigger in the latched position.

FIG. 24 is a side view of the knife 10 shown in FIG. 22. In this position, apex 152 of the V-shaped leaf spring 138 is in notch 156 of safety latch 134. This retains the safety latch in this locked position and because the apex is pressed against the latch, some force is required to slide the latch rearward and thereby unlock the mechanism.

Figure 25:
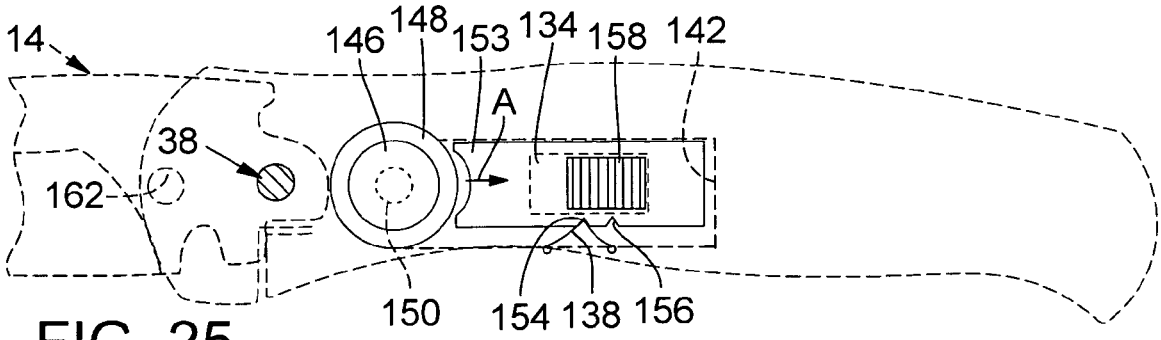
FIG. 25 is a side elevation view of the trigger mechanism shown in FIG. 24, except in FIG. 25 the trigger is in the unlatched position.

FIG. 25 illustrates the safety latch moved to the unlock position, where the latch has been slid to the rearward extent of elongate slot 160 (arrow A in FIG. 25). In this position apex 152 is in notch 154 and the semi-circular cut out 153 has cleared retainer ring 148. Once the retainer ring is thus released, trigger button 132 may be pushed inwardly (arrow A in FIG. 23) against the normal force of coil spring 136. As this happens, plunger 150 pushes against cap member 164.

Once the button is pushed inwardly a sufficient distance that cap member 164 exits opening 168 of liner 24, blade 14 is released and quickly driven open under the force applied to the blade by spring arms 82 and 84. The blade's rotation is stopped by forward end 21 of spine 20, which as noted functions as the blade stop, and is locked in the open position with blade locking mechanism 100 as detailed above. Cap member 164 is retained in blind opening 162, trapped between the blade and liner 24.

Figure 23:
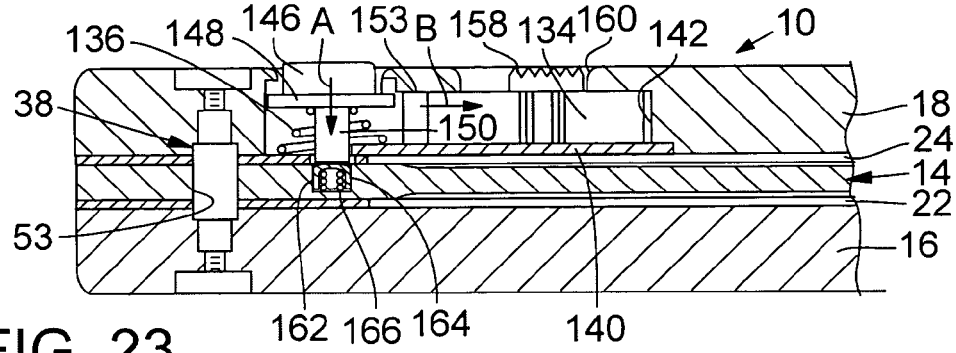
FIG. 23 is a partial sectional view of automatic opening knife shown in FIG. 20, illustrating trigger and latching mechanisms when the blade is in the closed position but in which the lock has been released, enabling the blade to be driven to the open position.

Finally, FIG. 25 is a side view of the knife 10 shown when it is in the position shown in FIG. 23.

Figure 26:
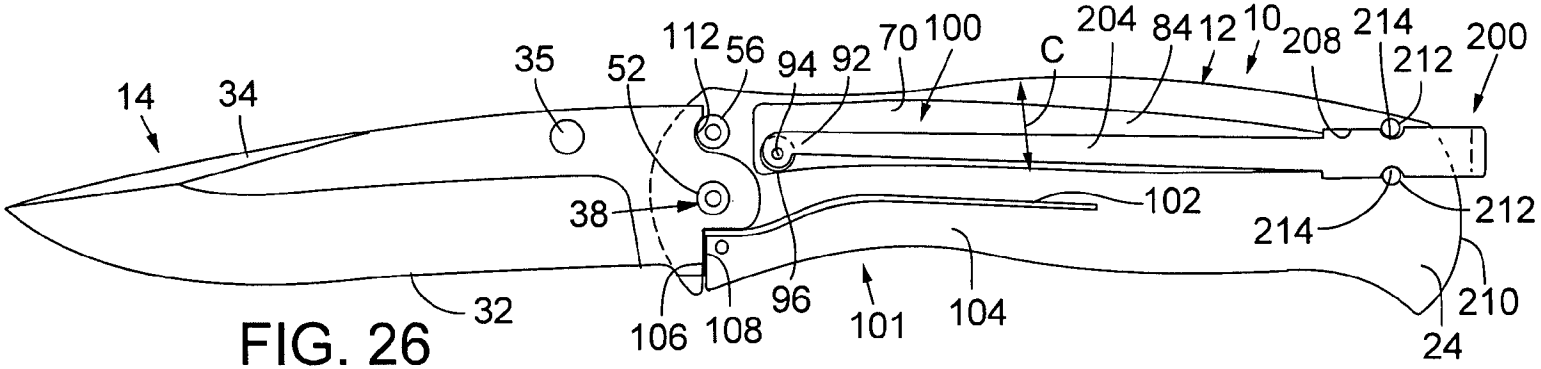
FIG. 26 is yet another alternative embodiment in which the opening assist mechanism is embodied in a removable spring mechanism.
Figure 27:
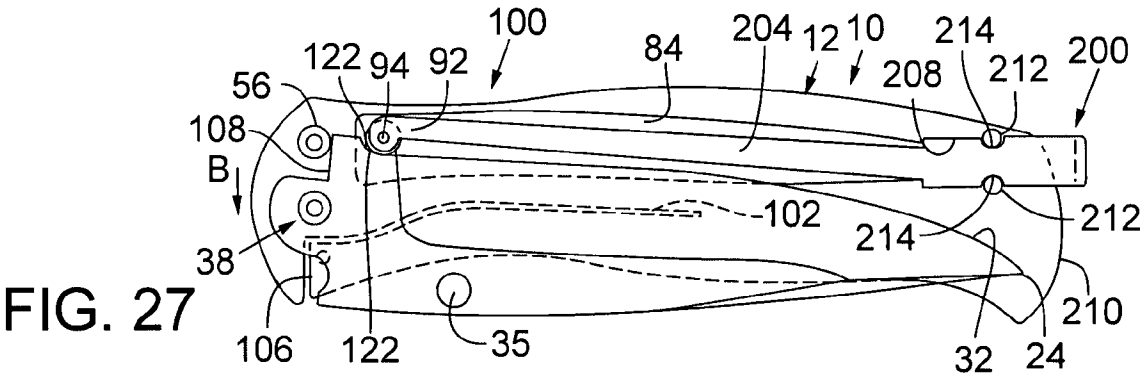
FIG. 27 is a side view of the knife shown in FIG. 26 with the blade in the closed position.
Figure 28:
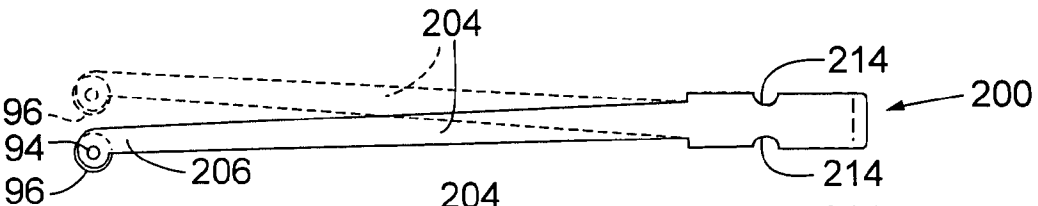
FIG. 28 is a side view of the removable spring mechanism of the embodiment of FIG. 26.
Figure 29:
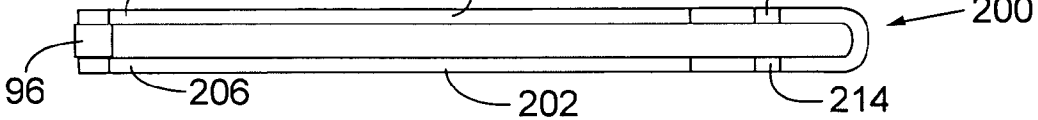
FIG. 29 is a top view of the removable spring mechanism shown in FIG. 28.

Another alternative embodiment is shown in the series of FIGS. 26 through 31. In the knife shown in these figures, the opening assist mechanism 100 is embodied in a removable spring arm mechanism shown generally at 200. Removable spring arm mechanism 200 is best seen in FIGS. 28 and 29 as comprising a unitary U-shaped member having opposed spring arms 202 and 204, which are interconnected at their distal ends 206 with a roller sleeve 96 that fits over a rod 94. The opposite ends of rod 94 are fixed in holes in the distal ends of the spring arms. Removable spring arm mechanism 200 is inserted into slots 208 formed in the butt end 210 of handle 12, only one of which is shown in the drawings, and is retained in the slot with a pair of posts 212. Posts 212 may be resilient or spring loaded and firmly secure the mechanism 200 in the slots, yet allow the distal ends 206 of the spring arms to move in an up and down motion (arrow C). The posts 212 rest in notches 214 in the U-shaped member when the mechanism 200 is inserted into the knife as shown in FIG. 26. The proximal end of the spring arm mechanism 200 fits snugly into the slot 208 so that there is very little tolerance between the slot and the spring arm mechanism. A roller sleeve 96 is fixed to the distal ends 206 in an offset manner so that the spring arm mechanism is reversible. Thus, as best seen in FIG. 28, the rod 94 extends through the distal end 206 of each spring arm to one side of the longitudinal axis through the spring arms. The roller sleeve therefore extends further to one side of the spring arms than the opposite side. This makes the mechanism reversible to function in two different ways depending upon the orientation of the spring arm mechanism in the handle.

In FIG. 26 the removable spring arm mechanism 200 is inserted into knife 10 in a first orientation in which the mechanism functions as a semi-automatic opener as described above. In this orientation, the spring arm mechanism is inserted such that the roller sleeve 96 is oriented downwardly, toward blade 14. In this orientation the spring arms 202 and 204 are "loaded" when the blade is in the closed position (FIG. 27), and are at rest when the blade is open (FIG. 26). The function of the spring arms and the way in which roller sleeve 96 operates on the tang of the blade is identical to that described above with respect to FIGS. 1 through 9.

The spring arm mechanism 200 is illustrated in isolation in the first orientation in FIG. 28. The dashed lines show the spring arms 202 and 204 when they are loaded (i.e., when blade 14 is in the closed position), and the solid lines show the spring arms when they are at rest (i.e., when blade 14 is in the open position). When the spring arm mechanism 200 is inserted into knife 10 in this first orientation, the knife opening mechanism is a semi-automatic type.

Figure 30:
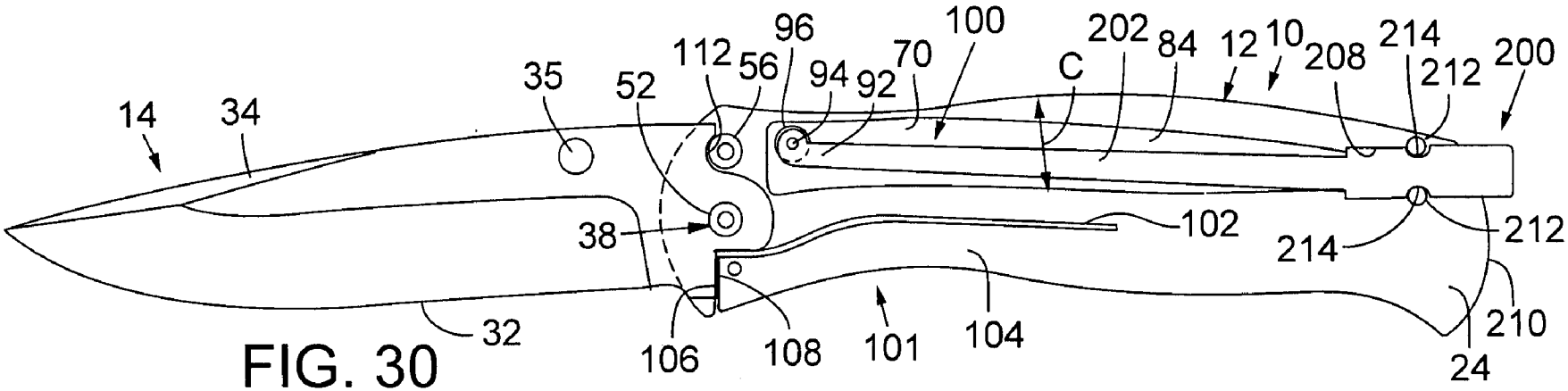
FIG. 30 is a side view similar to that shown in FIG. 26 except the spring mechanism is in a reversed position.
Figure 31:
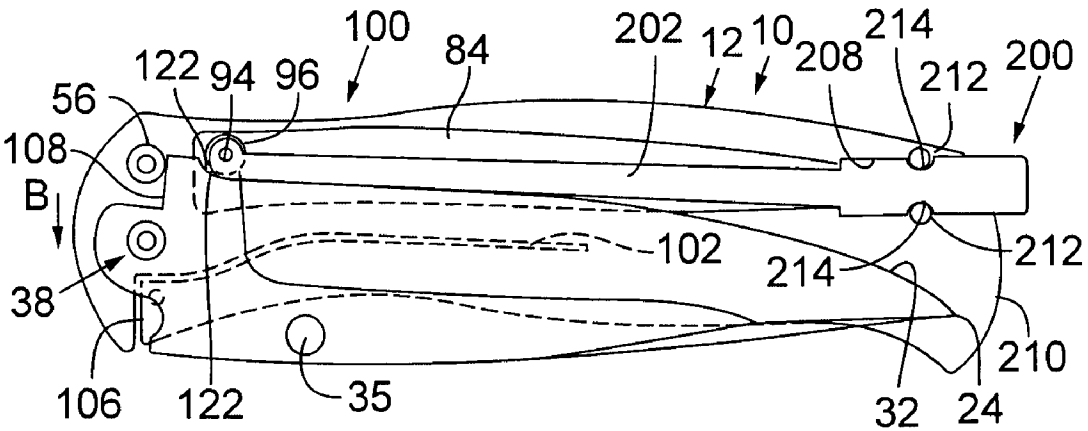
FIG. 31 is a side view of the knife shown in FIG. 30 with the blade in the closed position.

The spring arm mechanism 200 is illustrated in isolation in the second orientation relative to knife 10 in FIGS. 30 and 31. In this orientation the spring arm mechanism has been inserted into handle such that the roller sleeve is oriented upwardly, away from the blade. In this position the roller sleeve 96 does not bear on the blade 14 even when the blade is closed (FIG. 31), given the offset position of the roller sleeve in spring arms 202 and 204. As such, when the spring arm mechanism is inserted into knife 10 in this orientation, the knife functions as a standard manually opened folding knife.

With respect to all of the various embodiments described above there are several structural attributes of the materials that are used to fabricate spring arms 82 and 84 that may be varied in order to change the operating properties of the opening assist mechanism, regardless of whether the spring arms are separate pieces (as in the embodiment of FIG. 1) or are unitary pieces of the liners (as in the embodiment of FIG. 17). Similarly, the force delivered by spring arms 82 and 84 acting on the blade may be varied in numerous ways. For example, the characteristics of the material selected for fabricating spring arms will have a directed effect on the amount of spring force. The efficiency of the roller sleeve as it rolls over tang 30 should be maximized; that is, friction should be minimized. Judicious selection of materials for the roller sleeve and treatment of surfaces of the blade that the sleeve contacts help to minimizes friction between the roller and the blade.

Likewise, the thickness of spring arms (whether separate pieces or part of the liners) directly impacts the opening and closing spring force of the spring arms. Thus, when a thicker material is selected the spring force applied by the spring arms is greater. When the length of the spring arms is shortened, more force is applied to the blade. And the spring arms may be rods fabricated of a resilient material. All of these factors may be varied to control the opening and closing force applied by spring arms.

Figure 32:
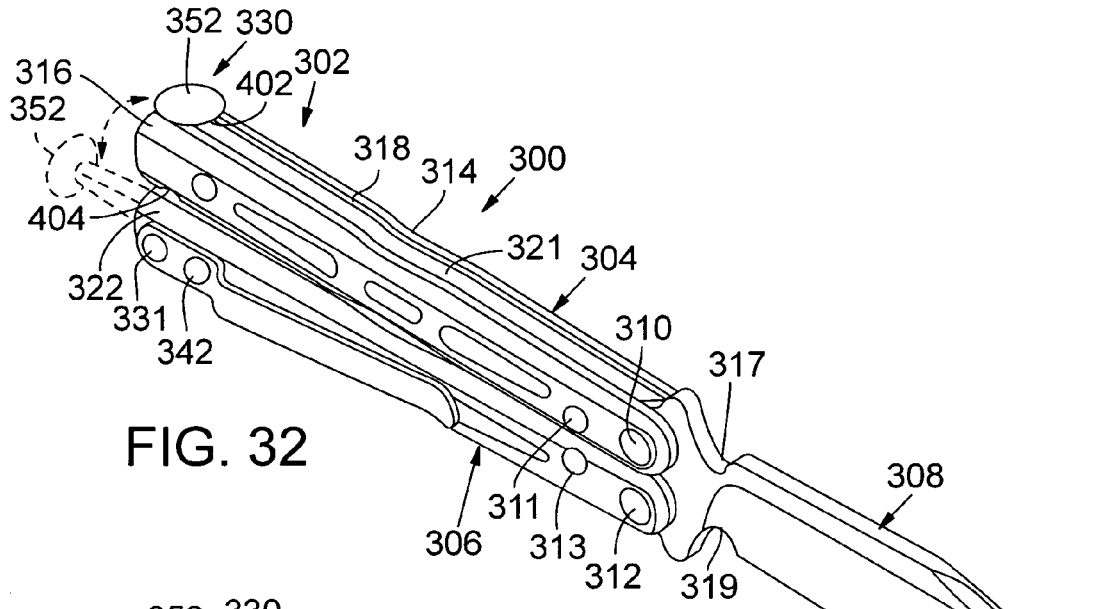
FIG. 32 is a perspective view of yet another knife that incorporates a mechanism according to the present invention; the knife shown in FIGS. 32 through 36 is a BALI SONG® style knife.

Those of ordinary skill in the art will appreciate that the fundamental principals of the invention may be applied to other structures used in different kinds of knives. One example of this is shown in the series of FIGS. 32 through 36. In these figures the principals of the present invention are utilized in a BALI SONG® style knife 300. This basic style of knife is well known. Briefly described with respect to the drawings, the knife has a handle 302 comprising two halves, upper handle 304 and lower handle 306, each of which is independently pivotally attached to a blade 308 at pivot axes 310 and 312. Each handle half has two side walls, some of which include liners. With respect to FIG. 32, upper handle 304 comprises a side wall 314 and a side wall 316. A liner 318 is positioned inwardly of side wall 314 and is held in a spaced apart relationship with side wall 316 to define a blade-receiving groove 321 therebetween. Lower handle 306 comprises a side wall 322 and a side wall 324 (which is not visible in FIG. 32). A liner 326, which is not shown in FIG. 32, is positioned inwardly of side wall 322 and an identical liner (also not shown) is positioned inwardly of side wall 324. A blade-receiving groove is defined between these liners.

Figure 33:
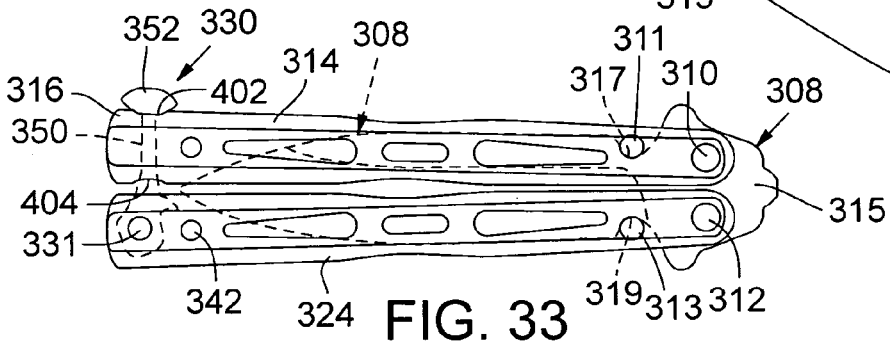
FIG. 33 is a side elevation view of the knife shown in FIG. 32 with the blade in the closed position.
Figure 34:
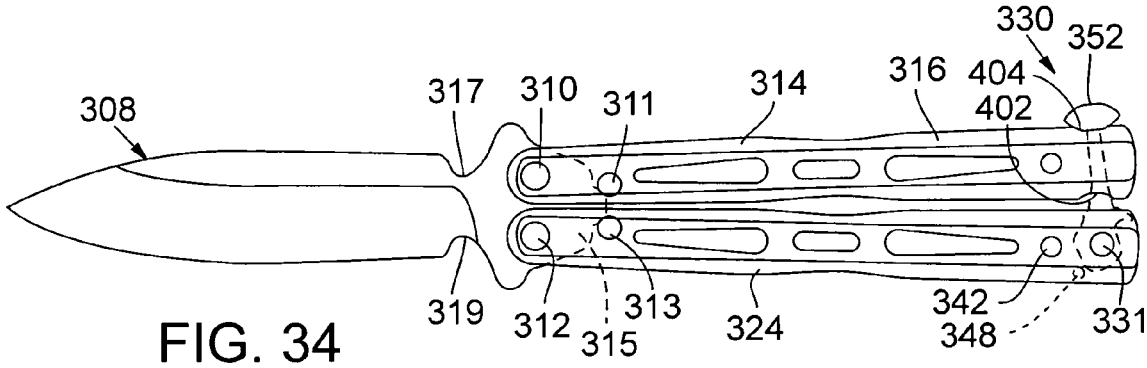
FIG. 34 is a side view of the knife shown in FIG. 33 with the blade in the open position.

As shown in FIGS. 32 and 33, each handle half 304 and 306 pivots about the pivotal attachment of blade 308 to the handles so that the blade resides within the handles in a closed position with the sharp edge of the blade safely stowed in the blade-receiving groove. This basic operation of a BALI SONG® knife is conventional.

Figure 35:
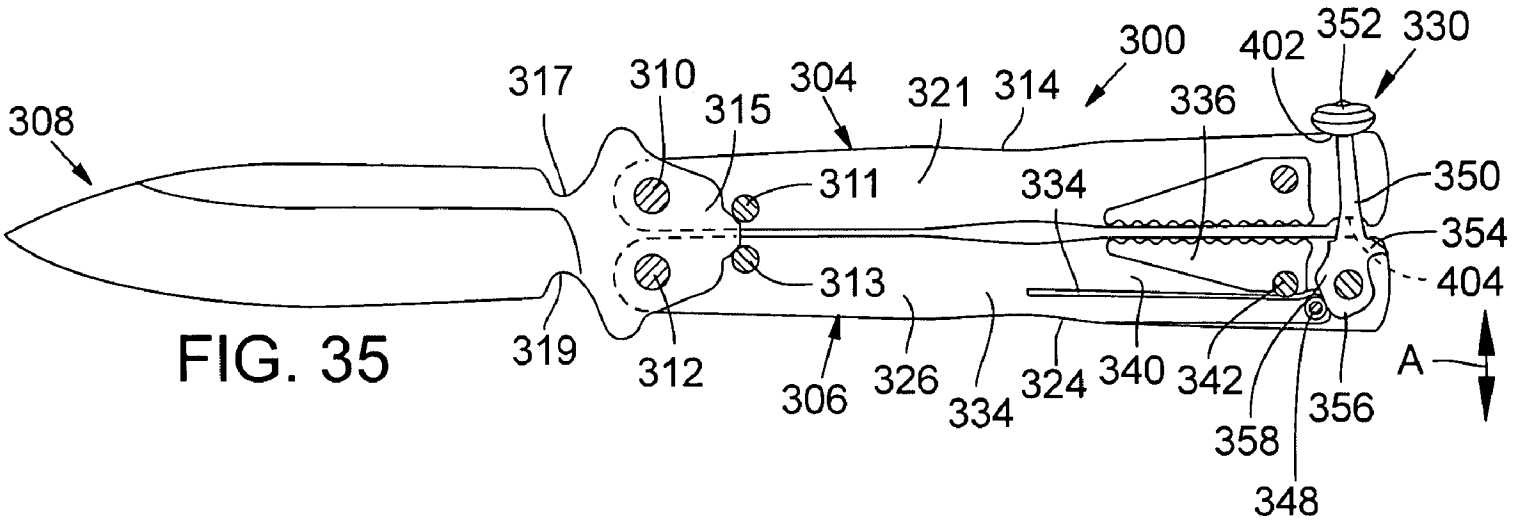
FIG. 35 is a side view of the knife of FIG. 34 with the near-side handle components removed to expose the interior components.

A keeper shown generally at 330 is pivotally attached to the inner-facing surface of side wall 324 of lower handle 306 near the butt end of the handle (i.e., the end opposite the attachment of blade to handle) with a pivot shaft 331. Keeper 330 functions to latch the two handle halves 304 and 306 together both when the blade is in the open position and in the closed position. In FIG. 35 the knife is shown in the open position and the side walls and liners on the near side of the knife have been removed to expose the interior. The blade 308 is stabilized in this position by virtue of a pair of pins 311 and 313 connected to handle 304 abutting tang 315 of the blade.

Liner 326 has a longitudinal slot 334 cut therein extending from a point approximately in the middle of the liner and extending through the rearward edge of the liner to define a spring arm 338. The upper section 340 of liner 326 is fixed to side wall 322 with a screw 342 that also attaches a blade guard 336. The rearward, or distal end of the spring arm is free and thus able to move in the directions indicated by arrow A. An identical liner to liner 326, which is not illustrated, includes an identical slot that defines an identical spring arm in the liner attached to side wall 324. A pin is attached to the distal end of each spring arm (that is, spring arm 338 and the spring arm defined in the liner attached to side wall 324) and interconnects between the two spring arms. Specifically, a pin 348 is attached to spring arm 338 and interconnects to the corresponding spring arm formed in the liner that is attached to side wall 324. As shown in the drawings, pin 348 may include a roller sleeve, which is as described above. The interconnected spring arms are movable in both directions (i.e., toward the fixed portion of the liners, and away from it), and pressure is required to move the springs in either direction. Stated another way, the spring arms act resist moving in both directions shown by arrow A.

As noted, keeper 330 is pivotally attached to side wall 324 with a pivot shaft 331. Keeper 330 comprises an elongate arm 350 attached at an inner end to side wall 324 with pivot shaft 331, and a retainer cap 352 at the opposite, free end. A small detent 402 is formed in one surface of upper handle 314 in a position to receive and nest the lower portion of retainer cap 352 when the knife is in the open position as illustrated in FIG. 32. Likewise a detent 404 is formed in the opposite surface of upper handle 304 to receive and nest the lower portion of the retainer cap when the knife is in the closed position FIG. 33.

The portion of keeper 330 that connects to side wall 324 includes a hook 354 and a shoulder 356 opposite the hook. When keeper 330 is attached to side wall 324 the free end of arm 350 is pivotal as illustrated in FIG. 36A with dashed lines.

Keeper 350 is operable to latch upper handle 304 to lower handle 306, both when the blade is in the open position, which further stabilizes blade 308 in the open position, and in the closed position. With continuing reference to FIG. 35, the blade is shown in the open position and arm 350 of keeper 330 is in a position such that retainer cap 352 is nested in detent 402 in upper handle 304—the arm 350 is pivotal in and resides in the blade-receiving groove 320. In this position, shoulder 356 of arm 350 is displacing spring arm 338 outwardly—that is, in the direction away from the fixed portion of the liner 326. This "loads" the spring arm, which puts pressure on arm 350. Because the spring arm is thus pressing against pin 348, arm 350 is held in this position under the spring force of the spring arm, acting through the pin on the keeper. The keeper thus maintains the upper and lower handles safely locked in the open position.

Figure 36:
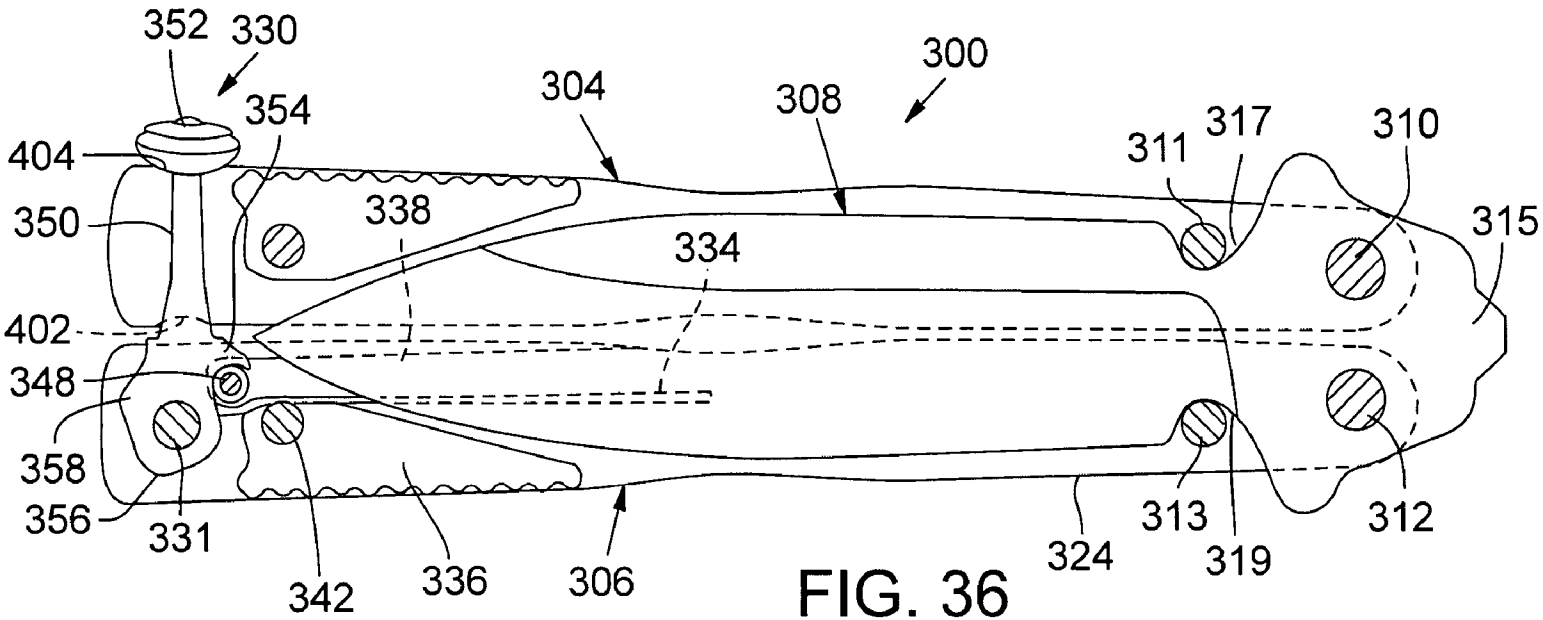
FIG. 36 is a side view of the knife shown in FIG. 35 with the blade in the closed position.

To unlock or unlatch the knife when the blade is in the open position shown in FIG. 35, the side walls 304 and 306 are squeezed together slightly and keeper arm 350 is rotate in the counterclockwise direction (of FIG. 35). With retainer cap 352 disengaged from upper handle 304, the two handle halves may be pivoted in opposite directions to close the knife, as shown in FIG. 36. In this position, pins 311 and 313 rest in semi-circular notches 317 and 319 in blade 308. The pins make contact with the blade slightly prior to the butt ends of the handles coming together. This, in combination with the fixed pivot axes 310 and 312 mandates that some force is required to bring the two handle halves completely together as shown in FIG. 36A. In other words, the two handle halves must be squeezed together with significant force in order to bring the butt ends of the handles together as in FIG. 36A. With the blade safely stowed between the upper and lower handle and the butt ends of the handles held together by squeezing them, arm 350 may be rotated about the ends of the upper and lower handles to latch the handles together. As arm 350 is rotated, hook 354 engages pin 348, thereby compressing spring arm 338 and "loading" it with spring pressure. The retainer cap is then slid into position in detent 404 and the squeezing pressure holding the two handle halves together may be released. Once the two handle halves are released (i.e., the squeezing pressure on them is released), the butt ends of the handles separate from one another because, as noted above, the pins 311 and 313 make contact with notches 317 and 319 prior to the butt ends of the handles coming together, and the blade to handle connections at pivot axes 310 and 312 are fixed. This relationship results in outwardly directed pressure, which pushes the two handle halves apart (i.e., in the directions opposite arrows B in FIG. 36A) retaining the retainer cap in detent 404.

Figure 36A:
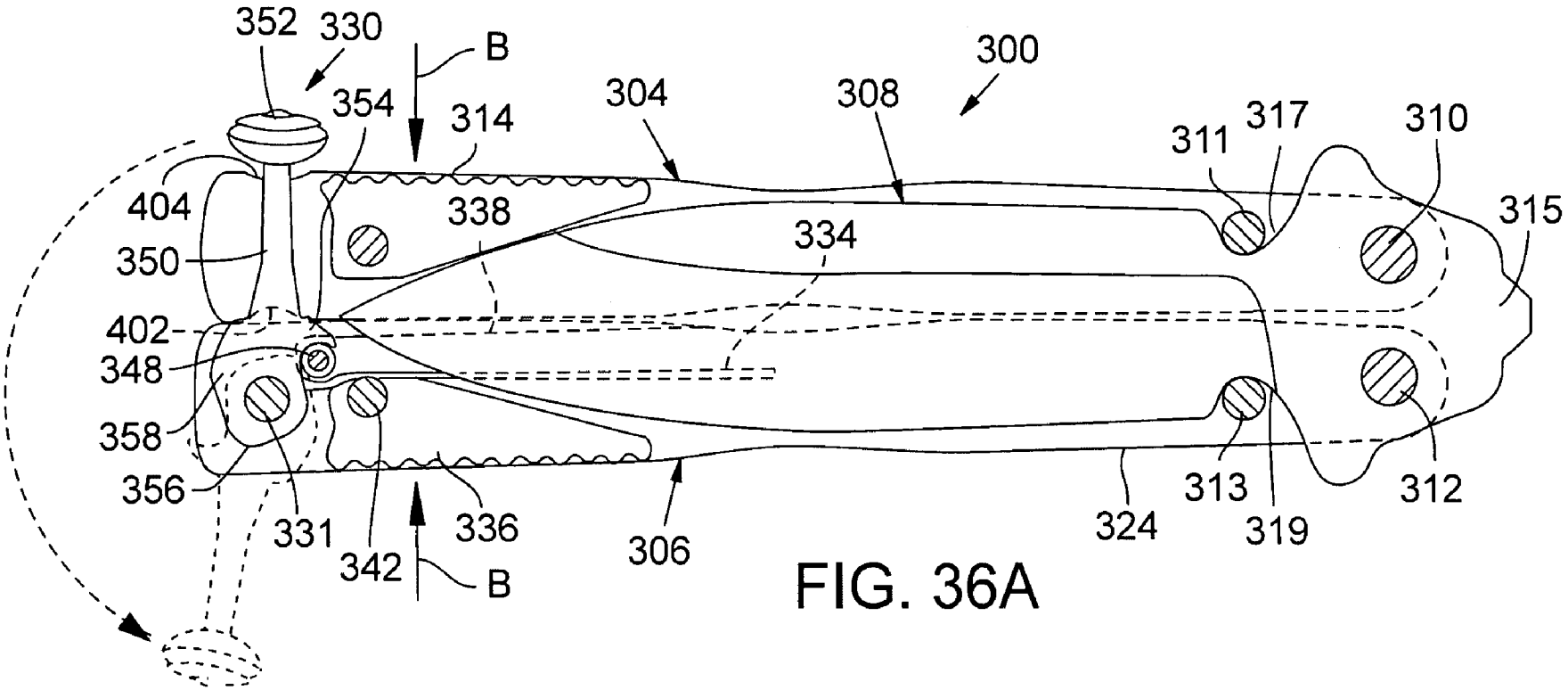
FIG. 36A is a side view of the knife shown in FIG. 36, illustrating how the blade is locked and unlocked.

With continuing reference to FIG. 36A, to unlock the knife, the two handle halves are squeezed together as shown with arrows B. As this is done, retainer cap 352 disengages from detent 404, and as this happens the arm 350 flips open under the spring pressure from spring arm 338 and the spring arm that is in the liner attached to side wall 324, unlocking the knife and allowing the blade to be moved into the open position. Thus, as the spring arms return to their normal, resting position when cap 352 disengages from detent 404, arm 350 is driven quickly to the unlatched position.

From the foregoing description it will be appreciated that the opening assist mechanism described with reference to FIGS. 1 through 31 may be applied to a multitude of other equivalent mechanical constructs. A few of those many embodiments are illustrated and described herein.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. A folding knife, comprising, a handle having first and second handle halves held in a spaced apart relationship to define a blade groove therebetween;

a blade pivotally connected between the handle halves at a tang and movable between an-open and closed positions;

a pair of spring arms, one on each side of the blade, each spring arm having a fixed end and a free end;

a pin interconnecting the free ends of the spring arms, said pin operatively positioned adjacent said tang for applying force to said tang and a sleeve rotatably received on said pin.

2. The folding knife according to claim 1 wherein said pin applies force to said tang to retain said blade in the closed position.

3. The folding knife according to claim 2 wherein said pin applies force to said tang to drive said blade to the open position when said blade is pivoted to a point where said pin passes a top-dead-center point on said tang.

4. The folding knife according to claim 1 including a first liner attached to the first handle half and a second liner attached to the second handle half wherein the spring arms are attached to the respective liners.

5. The folding knife according to claim 1 including a first liner attached to the first handle half and a second liner attached to the second handle half, wherein the spring arms are integrally formed in said liners.

6. The folding knife according to claim 1 including a trigger to lock the blade in the closed position and to unlock the blade so that it is driven to the open position.

7. The folding knife according to claim 1 wherein when the blade is in the closed position said pin exerts pressure in a notch in the tang to retain the blade in the closed position.

8. The folding knife according to claim 7 wherein when said blade is rotated toward said open position from said closed positions aid pin rides over an apex and when the pin passes said apex the blade is driven to the open position.

9. An opening assist apparatus for a folding tool having a handle with opposed handle halves and a slot therebetween, and a blade pivotally connected to the handle and movable about a pivot axis between a closed position wherein the blade is at least partially contained in the slot and an open position wherein the blade is extended away from the slot, said handle defining a longitudinal axis, comprising:

a first elongate spring arm having a proximal end attached to the handle and an opposite free end, a second elongate spring arm having a proximal end attached to the handle and an opposite free end, a pin interconnecting the free ends of the first and second spring arms, wherein said pin and said free ends are operable to move in a direction that is substantially transverse to the longitudinal axis and wherein said pin is operatively positioned for exerting pressure on said blade for retaining said blade in the closed position, and for exerting pressure on said blade to assist moving the blade into said open position when said blade is rotated about the pivot axis toward the open position beyond a threshold point.

10. The opening assist apparatus according to claim 9 wherein the blade rotates in a blade plane as it moves between the open and closed positions and each spring arm resides in a plane laterally to the side of the blade plane.

11. The opening assist apparatus according to claim 10 wherein the proximal end of the first spring arm is attached to one of the handle halves, and the proximate end of the second spring arm is attached to the other handle half.

12. The opening assist apparatus according to claim 10 wherein the proximal end of the first spring arm is attached to a first liner member that is attached to one of the handle halves and the proximal end of the second spring arm is attached to a second liner member that is attached the other handle half.

13. The opening assist apparatus according to claim 10 wherein the proximal end of the first spring arm is an integral pad of a first liner member that is attached to one of the handle halves and the proximal end of the second spring arm is an integral part of a second liner member that is attached the other handle half.

14. The opening assist apparatus according to claim 13 wherein, said pin further comprises a roller sleeve that freely rotates between said spring arms.

15. A folding knife, comprising:

a handle having first and second opposed side walls held in a spaced-apart arrangement to define an elongate slot therebetween;

a liner adjacent each side wall, each liner defining an integral spring arm cut in the respective liner, each spring arm having a proximal end integral with the respective liner and a free distal end;

a rotatable drive pin interconnecting the spring arms at the free distal ends thereof;

a blade having a working portion and a tang portion pivotally attached to one end of the handle, said blade movable between a closed position in which the blade is at least partially received within the elongate slot and an open position in which the blade is extended away from the handle;

wherein said drive pin is operatively positioned such that it contacts said tang portion and applies pressure thereto to retain said blade in the closed position and to move said blade from the closed position to the open position.

16. The folding knife according to claim 15 wherein each spring arm is further defined by a longitudinal arm having a proximal end attached to a respective liner and each spring arm having a free distal end, wherein the drive pin interconnects the spring arms at the free ends thereof.

17. The folding knife according to claim 15 wherein the rotatable drive pin further defines a rotatable sleeve.

18. The folding knife according to claim 15 wherein the rotatable drive pin contacts a notch in the tang portion when the blade is in the closed position.

19. A mechanism for providing an opening assist for a folding knife having a handle with opposed side walls and a slot therebetween, and a blade pivotally connected to said handle and movable about a pivot axis between a closed position wherein the blade is at least partially contained in the slot and an open position wherein the blade is extended away from the slot, the handle and the blade when in the open position defining a longitudinal axis, comprising;

a pair of springs interconnected by a drive pin spanning the slot and positioned operatively adjacent a tang portion of said blade for exerting pressure on said tang portion to retain said blade in the closed position and to urge the blade from said closed position to the open position after said drive pin passes a threshold point as the blade is rotated from the closed position to the open position, wherein said drive pin moves in a direction that substantially transverse to the longitudinal axis from a first position in which the drive pin retains the blade in the closed position to a second position when the blade is in the open position.

* * * * *